US005355820A

United States Patent [19]

Conrad et al.

[11] Patent Number: 5,355,820

[45] Date of Patent: Oct. 18, 1994

[54] MACHINES FOR MAKING LAMINATE SUITABLE FOR STRESS BEARING MATERIALS SUCH AS SAILS

[75] Inventors: Peter G. Conrad, Greensboro; John D. Sullivant, Suwanee, both of Ga.

[73] Assignee: Sobstad Corporation, Greensboro, Ga.

[21] Appl. No.: 920,613

[22] Filed: Jul. 27, 1992

[51] Int. Cl.[5] ..... B63H 9/06

[52] U.S. Cl. ..... 114/103; 156/179

[58] Field of Search ..... 114/102, 103; 428/109, 428/110, 112, 253, 292, 294; 156/179, 313

[56] References Cited

U.S. PATENT DOCUMENTS

| | | | |
|---|---|---|---|
| 3,829,339 | 8/1974 | Pinette | 156/179 |
| 4,945,848 | 8/1990 | Linville | 114/103 |
| 5,097,784 | 3/1992 | Baudet | 114/103 |

*Primary Examiner*—Jesus D. Sotelo

*Attorney, Agent, or Firm*—Fred A. Keire; William J. Spatz

[57] ABSTRACT

A method for thread laying and a thread laying machine; thread laying has been achieved by a machine that has a vacuum table and above it a gantry with a thread dispensing device on a shuttle operating in an x- and y- direction; the gantry may be fixed to a pair of carriage on the x-axis driven in unison or each of the carriages may be independently driven; curved threads as well as threads on a mold may be laid down on a substrate; typical material produced is sail material of considerable thread pattern complexity; single threads or a multiple of threads may be laid down through one thread head with an adhesive properly coating the threads; multiple thread heads as well associated apparatus such as laser cutters and the like are mounted on the gantry.

30 Claims, 17 Drawing Sheets

MACHINES FOR MAKING LAMINATE SUITABLE FOR STRESS BEARING MATERIALS SUCH AS SAILS

This invention describes a method and apparatus for the construction of sail materials, more particularly this invention discloses a machine for making materials suitable for sails, canopies and like structures of high complexity wherein the machine makes inter alia panels consisting of threads running in the direction of principal stresses in a laminate made of the threads laminated to a film material, such as polyester, polyvinylidene halides, polyurethanes, etc..

BACKGROUND OF THE INVENTION

Sail cloth has traditionally consisted of a weave of warp and weft threads. These threads lay transverse to one another, with the warp being the thread more capable of bearing the stresses than the weft.

Rather than being manufactured as a unitary piece, a sail is often constructed out of various panel layouts which are seamed together finally to construct a complete sail. Cutting the sail into panels allows the warp threads to be oriented in the direction of the various principal force lines, usually towards the boundary points of loading, i.e., attachment points of the sail to the vessel. These high load points include the head, the clew and the tack of the sail, where the loads are especially severe. However, in cutting the panels to approximate these principal force lines, the proper orientation is normally not achievable with woven cloth material. In addition, the warp threads "run off" the cloth, that is, the warp threads end at the edge of the panel, thus lacking any continuity along the force lines for any significant distance. This contributes to bias loading of the woven material. Woven material tends readily and sometimes (if laminated with a film) irreversibly distend when bias loaded.

Another disadvantage to a warp-weft technology lies in the potential for distention and weakness caused by the over and under nature of a woven material. Stretching and distortion of the material further result if the cloth is "off-parallel" and bias loaded to the weft direction. Certain processes may overcome this distortion, if the distortion is slight, including resinating the material, calendaring the material under heat conditions to stabilize the cloth, creating a very tight weave, laminating an isotopically resistant film, such as polyester film unto the cloth etc. However, most of these processes tend to be either material, labor, or capital intensive, and the approach of creating a tight weave results in an uneconomical use of thread in that only a certain percentage of the warp threads carry the actual load in addition to the relatively unused weft thread portion. Often the sail panels are tailored to reduce the bias behavior of the material, by narrowing the width of the panel at considerable increase in labor costs e.g. for sewing. Seams also introduce stress concentration wherever the needle punctures the sail material.

In U.S. Pat. No. 4,593,639 to Conrad, the inventor innovatively relieved the sail skin fabric of its primary role as "stress bearing member", by introducing stress-bearing structural members incorporated in the sail skin, in the form of fabric strips, yarns, monofilaments or laminate strips.

With U.S. Pat. No. 4,708,080 to Conrad, the concern over the warp, weft and cloth-panel orientation has been completely eliminated. Structural threads are predeterminedly located on each panel in a manner to achieve proper orientation of each of the threads in the panel and these threads are tied into a series of continuous catenaries for a sail.

Along with the simplified panel layout of a reduced number of panels, proper catenaries in the sail are formed in an improved manner thereby reducing the weight of the sail and improving its performance and durability. A monocoque construction of a sail is achieved by the proper joining of the principal or primary stress-bearing structural yarns in their catenary form in combination with the secondary structural elements, e.g., the grid members or scrim members.

More recently, U.S. Pat. No. 5,038,700 to Conrad, presents advances in the construction of light-weight sails, the corners of these sails, reef points for main-sails and other incorporated components in the sail, i.e., batten pockets, spreader patches and the like. Panels are made of a film with threads, foam, and film with or without threads. This last patent also discloses a wide variety of film and thread materials which may be useful. U.S. Pat. Nos. 4,593,639, 4,708,080 and 5,038,700 are incorporated by reference.

One attempt to overcome the problems associated with prior sail material bias distention of the sails has been presented by U.S. Pat. No. 5,001,003 to Mahr, which proposes a scrim of intersecting lines of yarn laminated between film and cloth, where the scrim is arranged to provide strength, integrity and stretch resistance to the sail material in the weft and bias directions. This technology still addresses the woven material problems and requires woven material substrates. Scrim comprised of parallel strands (i.e. warp and weft) and one knit strand was introduced as part of a laminated sail by U.S. Pat. No. 4,444,822 to Doyle et al.

Now that warp-weft direction of cloth and panel orientations are no longer a concern, the benefits of panel construction have changed accordingly. Rather than using panel layouts to align the warp threads with the load lines, the panel selection and layouts are now used as a method for optimizing the manufacturing of a sail appropriate for mass production, as well as a method for accurate laying of structural members in a sail, i.e., the primary and secondary structural members. Moreover, multiple laminates are also possible with the lamination schedule also adding to the necessary product enhancements.

U.S. Pat. No. 5,097,784 to Baudet reveals a method of sail-making in a unitary laminated piece. This method is costly and less attractive for mass production. A three dimensional mold is required on which only one sail is made. Each mold must be adjusted for each different sail as such method does not lend itself to broad seaming. Demand for an individual panel with a particular structural thread pattern in greater numbers than for other panels and different reinforcing patterns such as for reef points makes molded sails less suitable for flexible manufacturing and rapid changes. Hence, for an individual complete sail with a particular structural thread pattern, machine flexibility is highly desirable for thread variations in count, in size, in length and in layout pattern which cannot be achieved with a molded sail construction.

The quality of the product sail is diminished when made on a mold. Lamination problems occur when lamination is performed on the three dimensional mold. Further, although three dimensional mold techniques disclose applying tension to threads, these threads cannot be curved on the mold—it is believed impossible to do so unless the curved threads are restrained by pins.

By comparison, the present invention relates to a method and apparatus for manufacturing a sail panel for construction of a sail, with structural reinforcement threads incorporated in the sail panel in a large variety of complex and difficult patterns. In the present invention as well as the method presented in U.S. Pat. No. 4,708,080, threads are laid in tension across the sail skin through the use of pins around which the threads are looped. The pins not only provide the tension necessary to properly lay the threads down on the sail skin, but they also provide the direction necessary to lay accurately the threads down in their predetermined pattern.

In the prior art, known apparatus and methods include methods for manufacture of laminated reinforced film, for making fiber reinforced tape, for production of bias fabrics, warp knitting machines, and the like. Generally, prior art warp knitting machines have a weft insertion magazine which lays weft threads in parallel across the entire breadth of the machine and also has a substrate providing arrangement wherein the plane of the substrate subtends an acute angle with the plane of the weft thread and is further provided with at least one boundary element, in particular, a hold down means on the side of the substrate path opposite to the needle bar.

The thread is typically wound around certain elements, including a spindle, retractable element, needles and clamping means, and the like, before returning to their parallel path across the table. All of the known methods and apparatus relate to reinforcement means, threads, fibers, and the like that are laid out parallel to each other, failing to provide means for laying out reinforcement means, threads, fibers, and the like in non-parallel patterns.

In U.S. Pat. No. 4,052,239 to Chen, a fiber reinforced tape is manufactured by moving the tape through a first area while looping a thread on one side of the tape in a plane transverse to the direction of the movement of the tape. Each angled loop is held initially by a retractable pronged element and is then secured onto each end of the reinforced tape product by a vacuum belt, depositing the thread on the tape in a zig-zag pattern. Rollers such as heated roller then secure the thread to the tape. The apparatus described by Chen comprises a cross-belt moving in a closed loop transverse to the direction of the tape's movement, with the cross-belt having a carrier for the thread and looping means at each end of the cross-belt that move in and out of the plane of the thread as the thread is carried by the cross-belt. The machine can only produce a zig-zag pattern on the underlying film and not a varied pattern with convergent-divergent section, e.g. in the same panel, in opposite orientation to each other. A pressure belt is available to keep the loop ends in place, however actual adhesion occurs afterwards when the rollers secure the thread to the tape.

U.S. Pat. No. 4,397,703 to Osborn describes an apparatus for making a fiber-reinforced composite film sheet, which comprises a creel and fiber guides for forming the first lap of machine-direction fibers, and a pair of endlessly revolving roller chain assemblies supporting rows of spindles which are arranged to be initially interwoven, then divergent, and finally in parallel movement to form the second lap of transverse-direction fibers. This second lap of fibers are looped over selectively spaced-apart rows of spindles, and cam means are used to lift each row of loops from the spindles before lamination of film to the fibers. The machine is unable to create non parallel patterns of thread. It lays down threads that are substantially parallel to each other and cross threads that are at about 90° to the machine direction threads.

U.S. Pat. No. 4,556,440 to Krueger describes an apparatus for production of bias fabrics which provides for a layer of parallel strands held together by external means (including, but not limited to stitching). The layer is formed at various angles relative to the long axis of the fabric and is wrapped around a series of needles formed on moving conveyors, maintaining the parallel orientation of the strands within. The machine is driven by an oscillating crank mechanism whose oscillating drive shaft moves more slowly before its direction is reversed, causing the movement of the yarn carrier to be naturally slowed at the end of each course. The yarn carrier is attached to an arm extending the width of the fabric, and the yarn carrier is attached to the arm and lays down a plurality of yarns with each sweep. The machine at all times lays down a parallel tow of strands or threads. It does not have the ability to lay down non-parallel threads and in opposite orientation in the non-parallel configuration.

Further inflexibilities in the apparatus are found since both conveyor belts move at a constant speed toward the bonding mechanism where the fabric layers are bound together. The conveyor belts are only capable of movement in one direction, and they cannot move independent of one another, nor at different speeds from each other. This limits the range of patterns that can be created by the mechanism.

U.S. Pat. No. 4,867,825 to Gidge describes an apparatus for forming cross-wise filaments for non-woven fabric which is subsequently further modified by lengthwise direction filaments. The machines uses pins or grippers to put crosswise filaments in position to be adhered to edge elements. Pins are located on opposite ends of a table and in a center island that moves longitudinally along the table. Substantially parallel filaments are laid down by this machine. Gidge attempts to achieve a high degree of parallel uniformity by limiting the distances by which edge spacing pins can move, and by rigidly fixing the edge spacing pins relative to each other as a group.

U.S. Pat. No. 3,108,028 to Sprunck et al. describes an apparatus for the reinforcement of glass fibre webs or mats. According to the apparatus in Sprunck et al., a mat on a conveyor belt is reinforced by reinforcement means unravelled from a bobbin. Reinforcement means are blown by a stream of air from its holder into a gripper mouth. In the gripper mouth, the reinforcement means are stretched transversely across a mat at right angles to the direction of movement. The transverse reinforcing means, in a stretched-out position and in parallel relation, then rest on the mat. A band burner is ignited so that the transverse reinforcing means between the conveyor belt and the bobbins are melted at a position close to the edge of the conveyor belt. The gripper mouth then receives another feed of reinforcement means and returns across the mat for another pass. The result is the placement of strands across the mat in the undesirous form of individual and discontinuous strands.

U.S. Pat. No. 3,690,990 to Izumi describes an apparatus for manufacture of non-woven fabric. This apparatus reveals a means for extending yarns in a taught state in side-by-side parallel relation and equidistant from each other with other weft yarns about 90° across the warp yarns. Yarn is ejected by a jet of air under high pressure by a yarn injecting device through a slit over warp yarns extended side-by-side and equidistant from each other. The intersections of the warp and weft yarns are interconnected by a heating press, and the weft yarn is then cut from its source by a cutter.

The apparatus described in U.S. Pat. No. 4,992,123 to Cave et al. presents a method for laying down a weft filament by propelling the filament through a chamber with an air gun over a moving substrate. The filaments are cut, clamped and pulled down onto the substrate. The apparatus propels the filaments by air and jet streams through an elongate hollow chamber across the substrate, a complex and questionably reliable method for laying down filament is involved. By pivoting the apparatus, the angles, at which the filaments can be laid onto the substrate, can be controlled. However, it is believed extremely difficult to propel a yarn impregnated with an adhesive. When the filament is clamped, it is pulled down through a closed aperture, then moved down onto the substrate while under tension once the aperture opens. Deposited on the substrate is the filament in the undesired form of an individual and discontinuous strand. In addition, absent from the apparatus in Cave et al. is a means to provide continuous, immediate and direct control of an adhesive coated filament as it travels across the substrate.

U.S. Pat. No. 4,804,436 to Debroche et al. describes a machine for the manufacture of a tire reinforcement cord yarn. The patent describes a tacky yarn fed to a device for receiving reinforcement cord that represents physically the path of the cord just before it touches the molded surface on which it is placed (i.e., a tire) and assures great precision of the laying of the cord. The device is formed of plates and located on opposite sides of the cord so as to assure a guidance of the cord. The device can be shaped so it can move the cord slightly away from its normal trajectory. The device also consists of flexible holding means so that the device can adjust to the curvature of the tire. The filaments however are laid out in parallel.

A method for making a composite component using a transverse tape is described in U.S. Pat. No. 4,938,824 to Youngkeit. This method comprises a laying of a flat tow at various angles across a conveyor belt to form a composite layer. Because the tow is flat, it is cut at each edge. The tow band consists of resin impregnated strand portions which are unwoven, unknitted and unstitched. If the tow were to turn around a pin, it would build up unwanted thickness, provide erratic turns, create a waste of material and cause uneven and poor fabrications of film—thread bonding.

Youngkeit fails to provide means for maintaining tension in the tow band because the tow band must be cut after placement of the tow band onto the base surface. Since the tow bands lie parallel to each other, there is no need in Youngkeit for pivot points around which strands are wrapped.

Australia Pat. No. 282,875 to Byrne presents a method and apparatus for obtaining reinforced web or sheet material or open mesh scrim. Individual strands or filaments are delivered and laid on top an advancing web or sheet material by at least two paired flying shuttles. The strands are laid out in transverse parallel relationship onto the web or sheet material.

In Canada Pat. No. 523,494 to Polley, lengths of parallel reinforcement thread are delivered in sucession and extended in parallel to one another across a paper web. The thread is delivered by two rotating members, one having a thread delivery head and the other a thread pickup head. A closeable jaw is located on the thread pickup head, and aids in keeping the thread taught upon receipt to ensure a clean and easy severance of the thread by a rotary cutter.

The apparatus described by Polley fails to provide continuous, immediate and direct control of threads as it travels across the paper web.

U.S. Pat. No. 4,550,045 to Hutson describes biased multi-layer structural fabric composites stitched in a vertical direction. Three layers of parallel fibers, with no secondary fibers in the plane of each layer, are laid down in the warp and weft stitching technology of Hutson. At least one of the layers is biased at certain angles. All of the threads are laid down in parallel in their respective layers. The fabric is saturated with a resin and cured. Three carriages lay down each layer of parallel fibers and a stitching machine stitches the layers together in the vertical direction, using a belt of hooks or needles at a sufficient height for the number of layers.

The apparatus described in Hutson requires careful coordination of the speed of the lay down carriage with the knitting machine and the means for advancing the fibers toward the stitching machine.

The apparatus described in U.S. Pat. No. 4,437,323 to Hittel et al. introduces a warp knitting machine having a weft thread magazine and a substrate provider for delivering the substrate along the substrate path. The magazine can transversely lay weft threads across the breadth of the machine again in parallel on the weft path upstream of the needle bed.

U.S. Pat. No. 3,823,049 to Vetrovec describes a rotary way of forming reinforced web with a zig-zag pattern of threads. Web is reinforced by glued warp and also can be bonded to a dry base strip. Loops around randomly arranged points are unobtainable. Only loops at consecutive points along the needles and the like are obtainable.

A method of manufacturing a flexible sheet material is achieved in U.S. Pat. No. 4,883,551 to Britton, by introducing a plurality of parallel strands by a weft laying device onto a paste-like bonding material deposited on an endless belt. Subsequent pluralities of strands are similarly introduced in the warp and weft directions atop each other. The material is finished upon curing by a heated roller. The apparatus is specifically designed for laying out all strands in substantial alignment with one another. This is done by the pivoting of a rail about an axle by a minimal angle determined by the weft laying device's (i.e., weft carriage) position as it completes a strand.

Sinusoidal waves can be created in a reinforced composite material as shown by the methods and apparatus in U.S. Pat. No. 4,398,650 to Holmes et al., U.S. Pat. No. 4,481,054 to Clausen et al., and U.S. Pat. No. 4,769,202 to Eroskey et al. In Holmes, sinusoidal waves are generated by a shaft that rotates a pin causing a reciprocating arm to move transverse to a corrugated medium.

The ability to generate sinusoidal waves is not suitable for the manufacture of sail panels for sail construction because strands in a sail panel must bear a load equally or be oriented in a catenary fashion, i.e., threads must be interconnected between point loads such as a tack, a clew and a head. A sail's efficiency in the wind increases with the ability to resist bulging or conversely the ability to be flattened. Since sinusoidal patterns in a sail panel would create a distortion, the sinusoidal generating apparatus presented in Holmes, Clausen and Eroskey is not suitable for making a sail material.

BRIEF DESCRIPTION OF THE PRESENT INVENTION

Unlike the aforementioned methods and apparatus, the present invention provides means for laying out reinforcement means, threads, fibers, and the like in non-parallel variable patterns, such as thread angles opposite to each other at edges of the sail, as well as means for ensuring that the reinforcement means, threads, filaments, fibers, and the like are taught and accurately placed in their predetermined positions.

According to the present invention, materials are constructed with improved thread layouts in order to bear stress such as when incorporated in a sail. The fibers are typically laid down on a film, but a fabric, a laminate of fabric and film may also be used.

Film is held down on a table along the table's x- and y-axis such as by vacuum or clamps, etc. Thread layout is achieved by pair of guide rails run along the length of the table, upon which a carriage is supported. Each carriage is capable of movement in unison or independently of each other and in both positive and negative directions along the x-axis along the guide rails.

Accordingly, a gantry with extension means is provided to allow the individual carriages the flexibility to reach a variety of predetermined points along the guide rails. Thus, interconnected with each of these carriages, a gantry extends across the y-axis of the table from one guide rail to the other. Mounted on the gantry may be a number of devices to satisfy a number of needed operations, e.g. at least one thread dispensing means which lays out the thread is capable of movement across the gantry along the y-axis. With this carriage and gantry system, a plurality of complex, difficult, non-parallel patterns may be achieved.

Means and apparatus for precise and accurate placement of a taught thread are also provided in the present invention. Thread dispensing means are provided with controlled adhesive impregnating means to dispense a thread in a predetermined manner on the table. Adhesive dispensing means are joined to the thread dispensing means to adhere the thread to the film upon its placement on the film. All thread positions are predetermined and thus can be reliably repeated over an unlimited number of runs. Along the x-axis of the table are located the devices for predetermined placement of the thread, e.g., for re-looping a thread around to obtain precise placement of the thread in a taught manner and its securement to the film. To accommodate a high density pattern (FIG. 14), such as at the clew, head or tack of a sail i.e. corners these re-looping means can also be lined up in a staggered or intermittent fashion along the y-axis of the table with a first, second, or third tier of re-looping means. Re-looping means can also be used to obtain curved and non-parallel patterns running primarily along the x-axis. Whenever a tiered re-looping means are provided, a means for reinforcing the film may be necessary at the locations where the re-looping means penetrate the film.

Another function of the present invention is to allow for production at a high rate of speed with different interchangeable functions in place. These functions include substituting different types and sizes of threads, drawing on the film with marking means, cutting means for the film and thread along the broadseam lines on the table, laser cutting means, and programming the machine drives so that requirements for the functions or demands of the apparatus can be met.

Accordingly, the present invention is to provide a machine as versatile as possible to make, at high production rates, a varied selection of panels based on the size of the boat, the type of sail, and the weight of the sail. Moreover manufacture of these varied patterns at a high rate of production with high accuracy and precision.

DETAILED DESCRIPTION OF THE DRAWINGS AND THE EMBODIMENTS OF THE INVENTION

With reference to the drawings where the same items are illustrated by the same numbers and wherein these show the various embodiments of the present invention:

Figure 2:
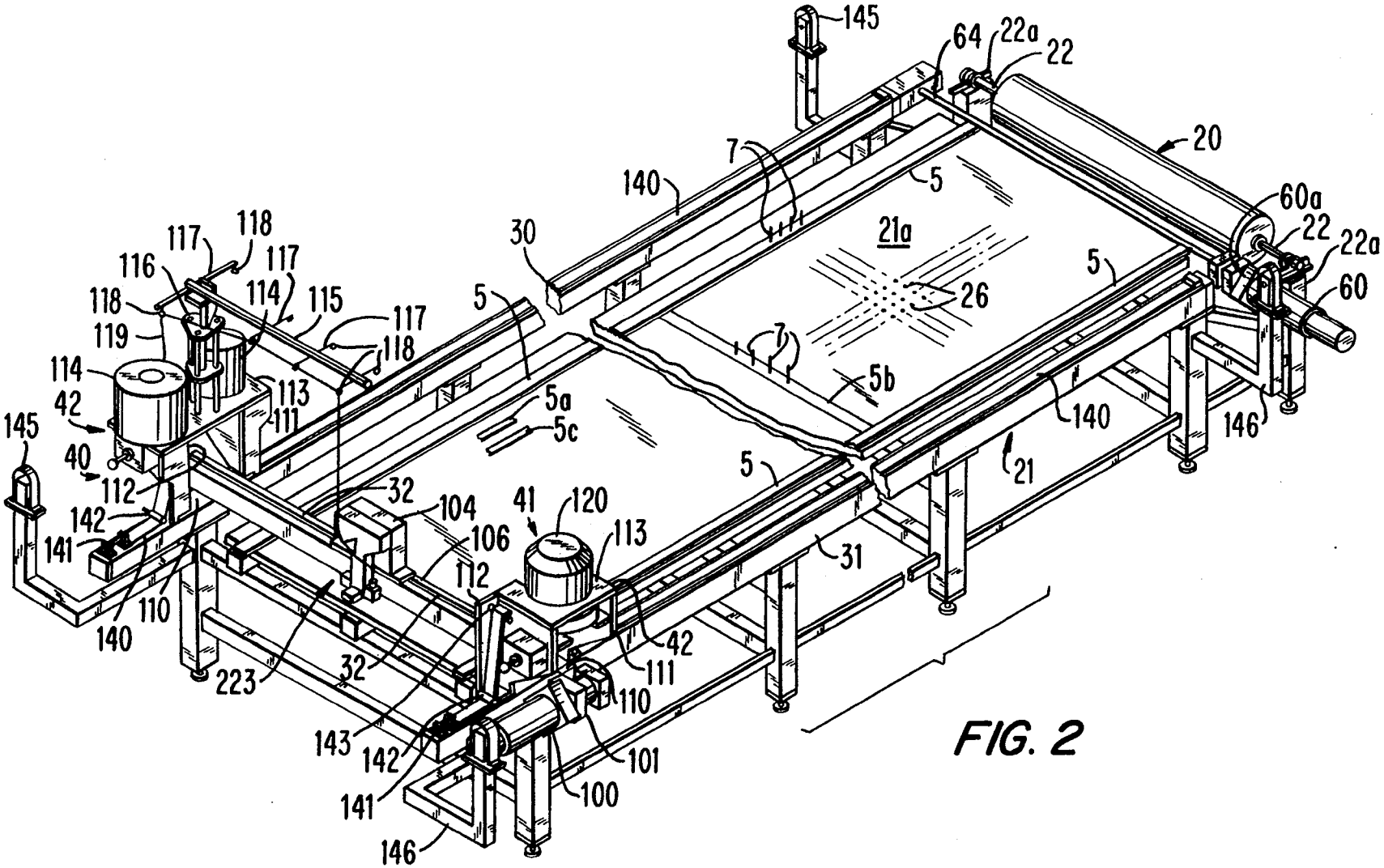
FIG. 2 illustrates in a perspective more detailed view a further embodiment of the present invention.
Figure 7:
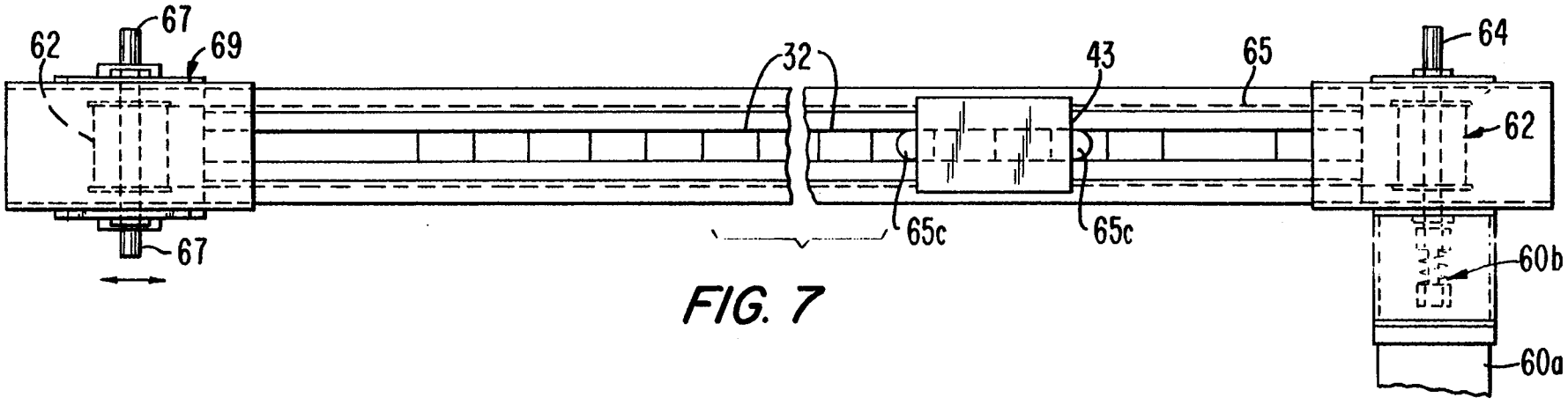
FIG. 7 illustrates in a top view an x-axis rail of the table.
Figure 8:
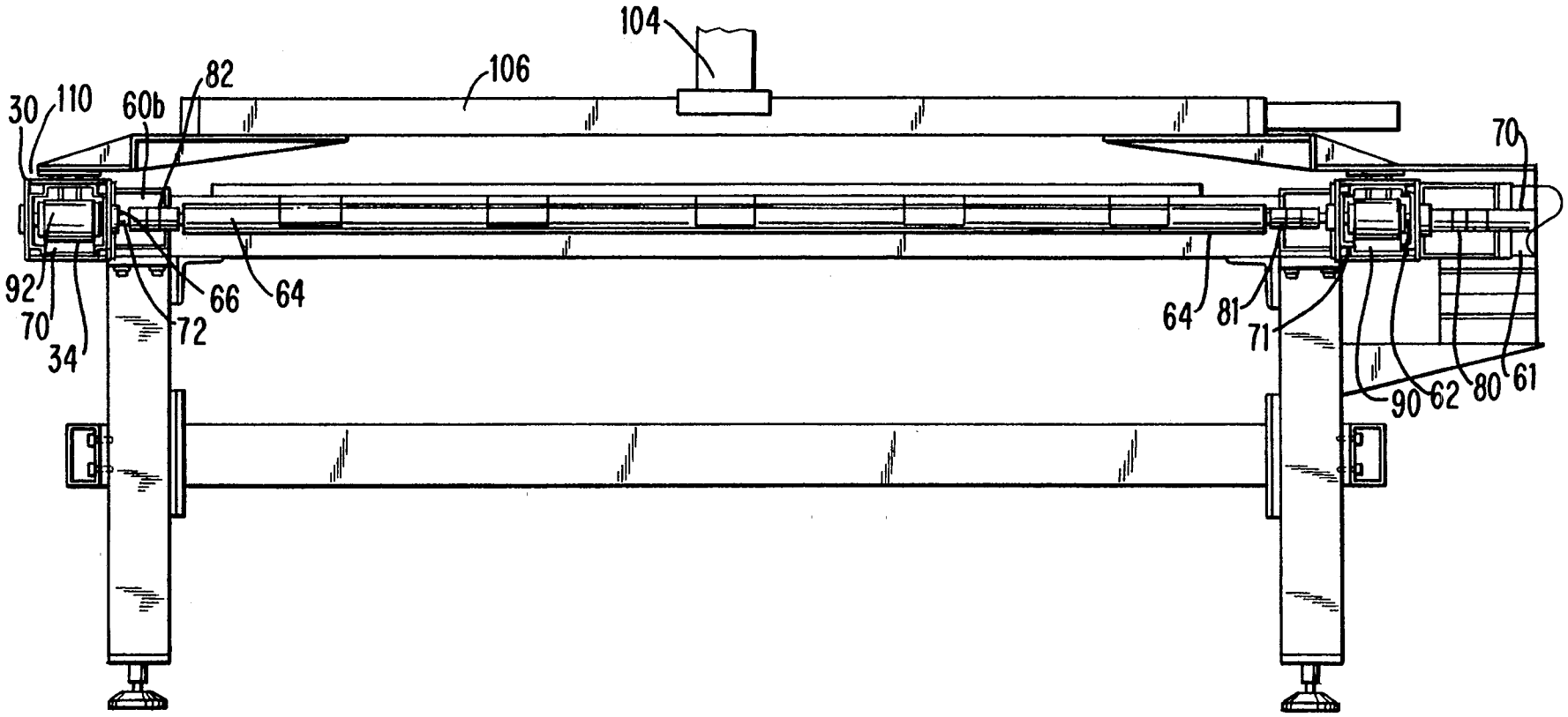
Figure 9:
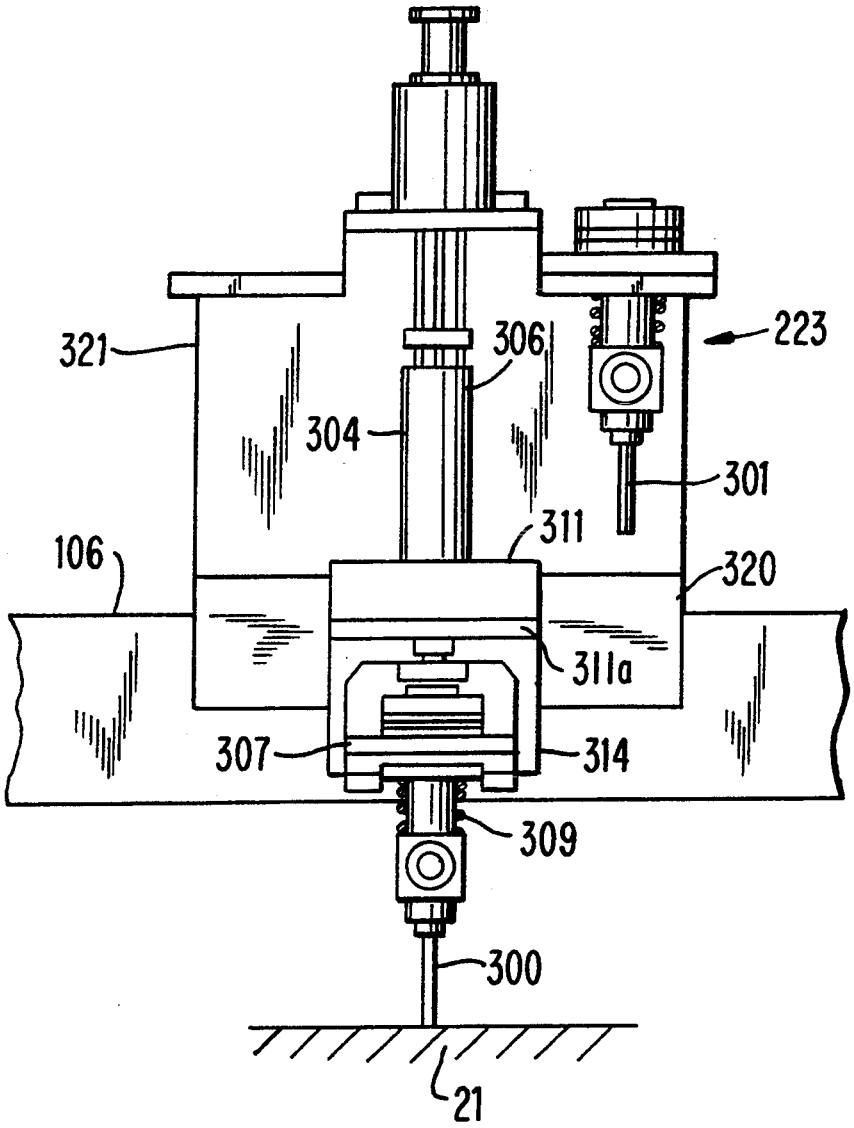
Figure 10:
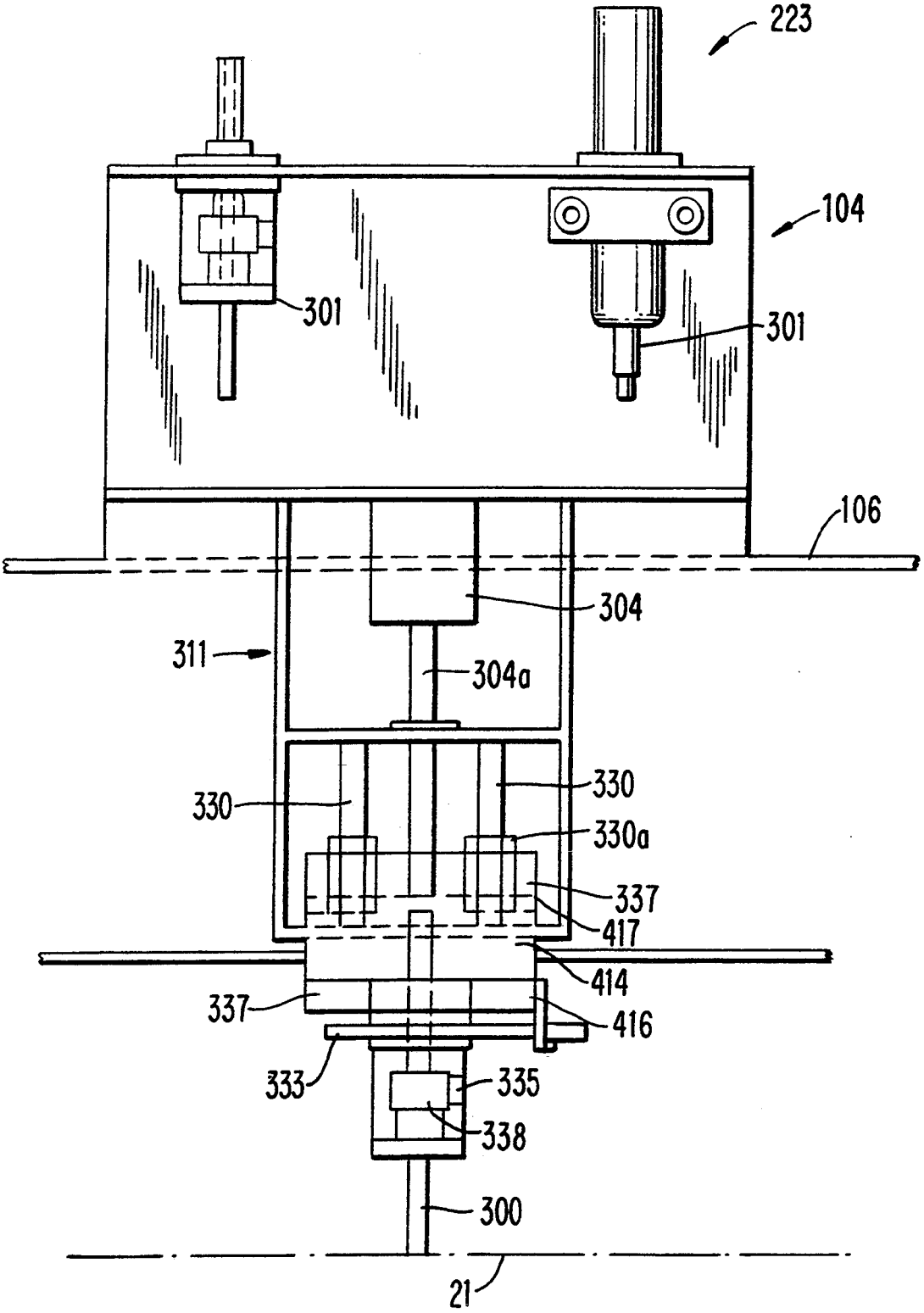
Figure 11:
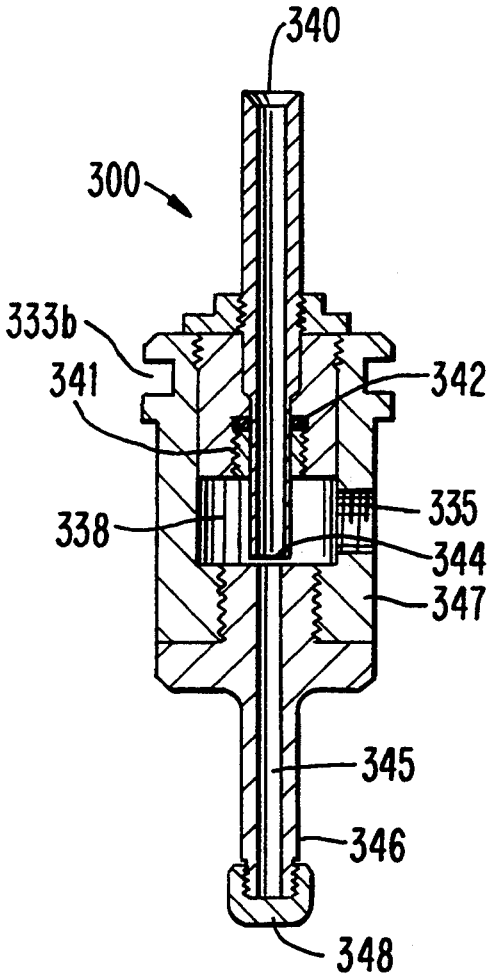
Figure 12:
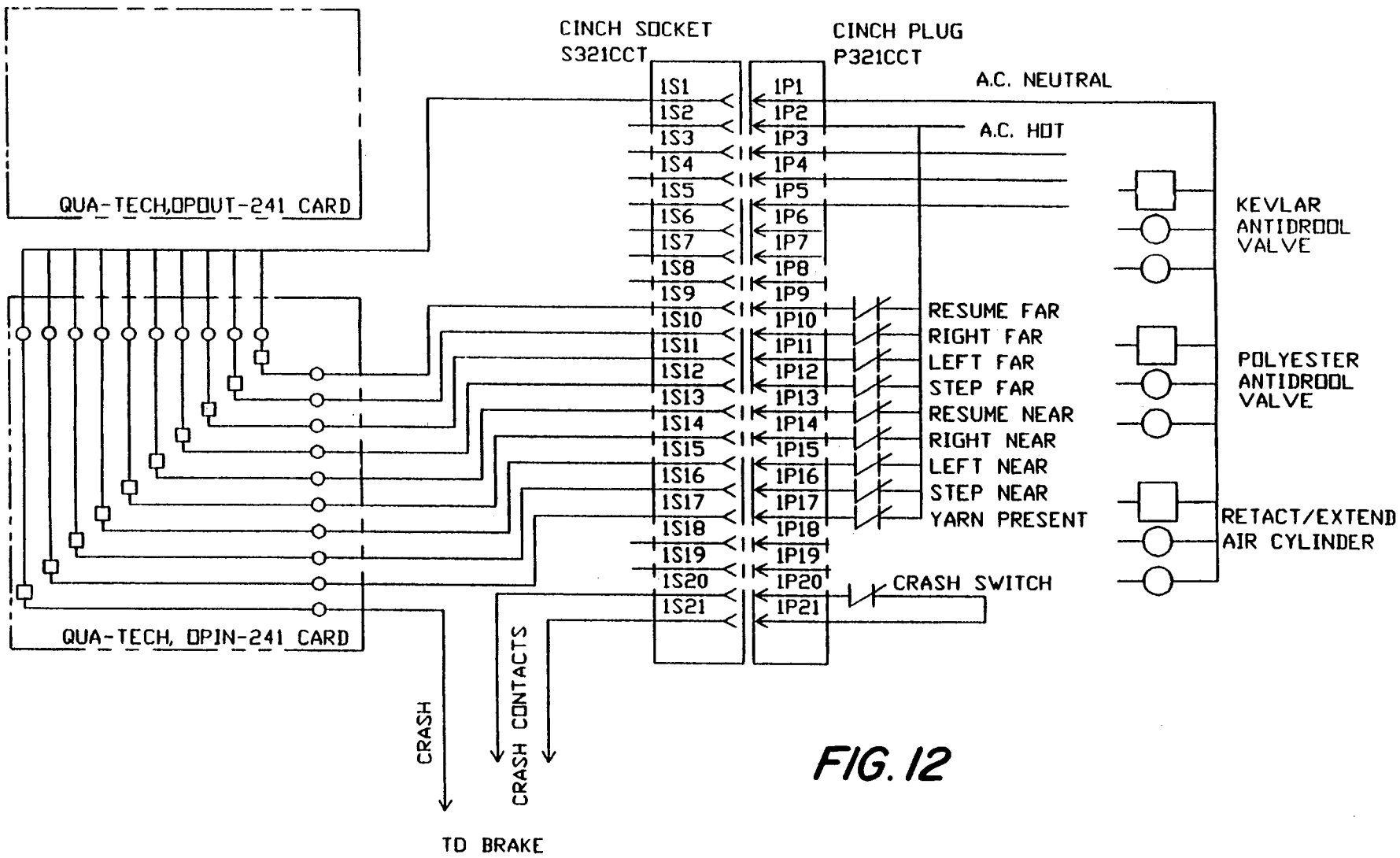
Figure 13:
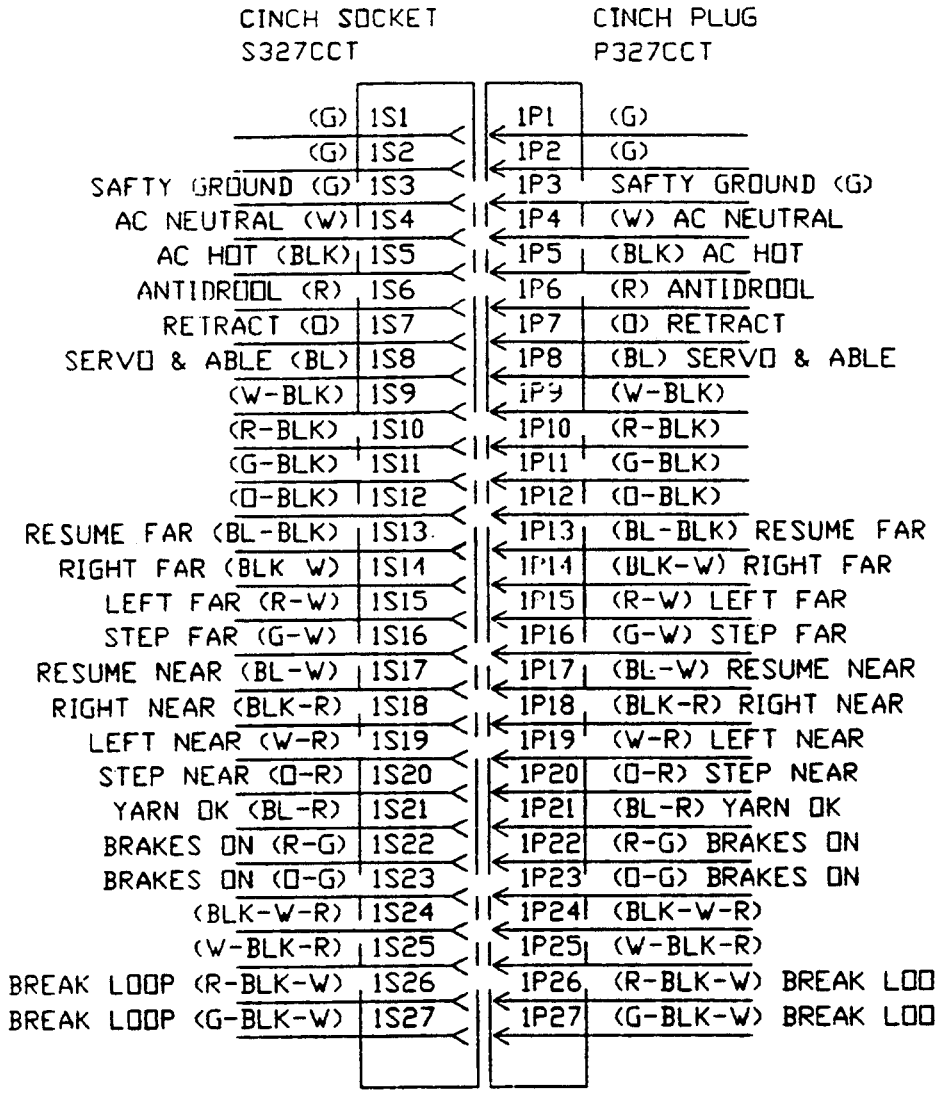
Figure 13:
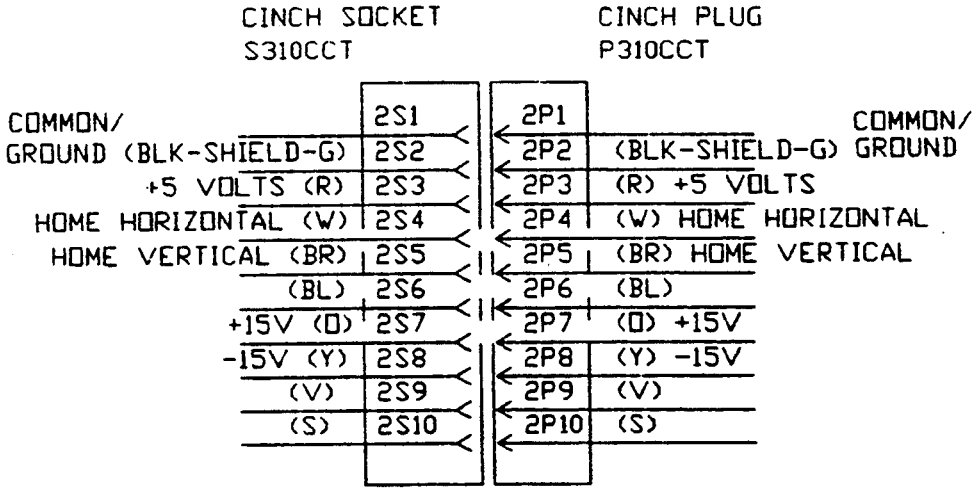

FIG. *7a* illustrates in a partial break out side plan view the x-axis rail of the table shown in FIG. 7;

FIG. 8 illustrates in a front view an x-drive connection including an x-axis longitudinal motor and a gantry between the two x-axis;

FIG. *8a* illustrates a detail of the left hand guide rail x-drive connection shown in FIG. 8;

FIG. 9 illustrates in a front view one embodiment of thread dispensing means;

FIG. *9a* illustrates in a side view the thread dispensing means shown in FIG. 9;

FIG. 10 illustrates in a front view another embodiment of thread dispensing means;

FIG. *10a* illustrates in a side view the thread dispensing means shown in FIG. 10;

FIG. *10b* illustrates in a top view the thread dispensing means shown in FIG. 10;

FIG. 11 illustrates in detail in cross-section a thread dispensing head;

FIG. 12 shows a process control circuit in form of a schematic, self-descriptive, safety feature input-output controller for the machine of FIG. 2;

FIG. 13 shows another schematic self-descriptive of an input-output controller of the machine of FIG. 2; and FIG. *14a* to c illustrates a number of panel patterns achieved by the present invention.

Figure 1:
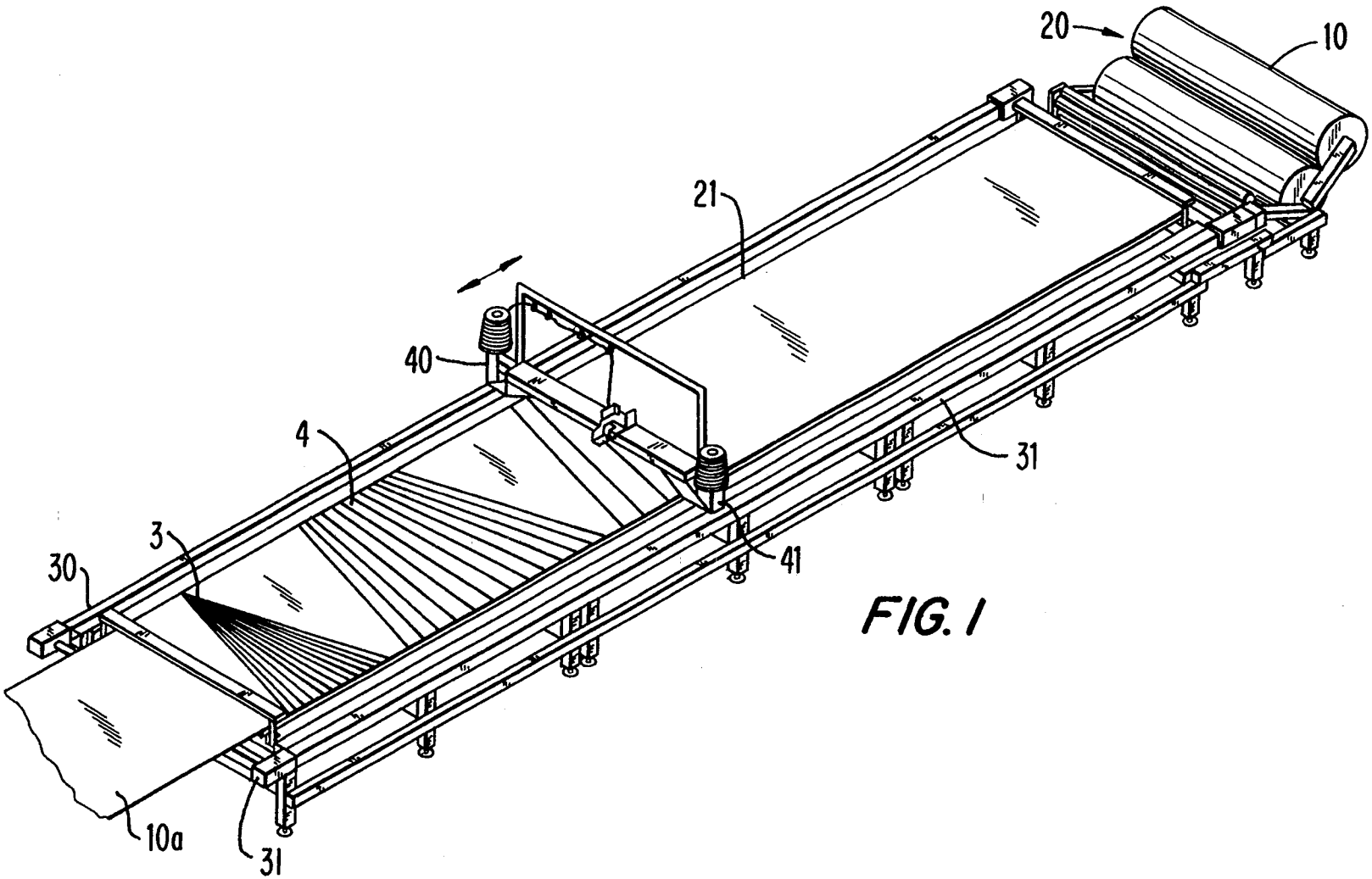
FIG. 1 illustrates in a perspective schematic view an embodiment of the present invention.

In accordance with the present invention as shown in FIGS. 1 and 2, at least one roll of film 10*a* is stocked in a feed station 20 located at the head of a table 21. The roll rotates about an axle 22 that rests on posts 22*a*. The roll of film 10*a* may be adjusted along the axle 22 to accommodate rolls of varying widths. The axle is mounted on framework 24 which may or may not constitute part of table 10 and is located at the head of a table 21, at a height slightly lower than the top of the table 10 so that the film 10*a* is able to roll smoothly onto the table 10 and its top surface 10*b*. Framework 24 may also be part of table 10 as shown in FIG. 2. The film 10*a* is rolled onto the top surface 10*b* of Table 10. Table 10 has a width of about 60 inches to about 180 inches and a length of about 30 feet but may be longer or shorter.

The table 10 is equipped with vacuum passages 26 (FIG. 2) whose suction secures the film 10*a* in position. The vacuum passages 26 can be interconnected and spread out uniformly throughout the entire table 10 or located in certain isolated sections of the table 10. Directly underneath the table 10 is a vacuum plenum 27 of a construction which allows for internal support and resists the pressure created by a vacuum motor 29 (not shown). The vacuum reaches the film through the vacuum passages 26 that are open through the table surface 10*b*.

Bordering the table 10 are left hand and right hand guide rails 30 and 31, respectively, which run along the length of the table in x-axis thereof. The guide rails 30 and 31, respectively, are slightly spaced above from the table surface 10*b*, to allow for left hand and right hand carriages 40 and 41, respectively, to be run along the guide rails 30 and 31 without interference from the table top surface 10*b*. Each guide rail 30 and 31 is in the form of a rectangular box section. On the top of each guide rail 30 and 31 is a continuous open slit 32 that runs the length of each of the guide rails 30 and 31. The slit 32 may be covered as further described herein.

Supported on the guide rails 30 and 31 are left hand and right hand carriages 40 and 41, respectively. Each carriage 40 and 41 is capable of movement in both positive and negative directions, i.e. in forward and backward direction, along the x-axis on the guide rails 30 and 31. Details of the carriage 40 and 41 construction will be described below. Each carriage 40 and 41 may move in unison or move independently of the other; for instance, left hand carriage 40 can move in a direction different from, as well as at a different, but proportional rate of speed than the right hand carriage 41. This feature will be further described herein.

Figure 7A:
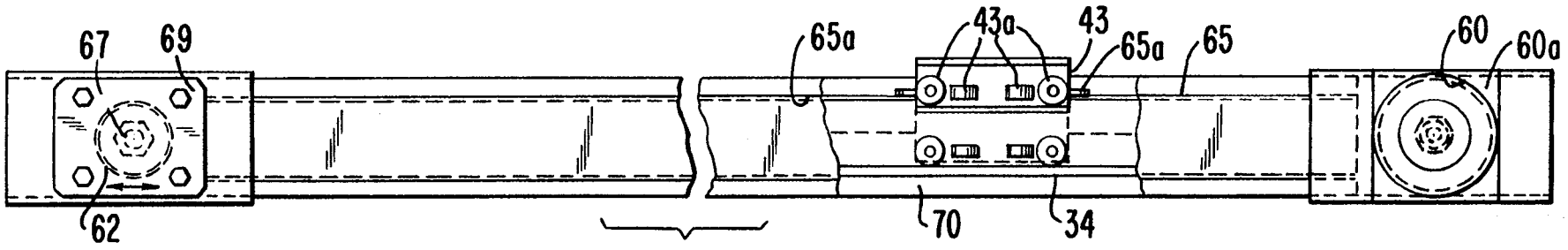

Each carriage is comprised of an inverted U-frame housing 42 that is well above the table surface 10*b* and that rides on a wheel trolley 43 in the guide rails 30 and 31, respectively. This wheel trolley 43 is shown in FIG. 7*a* and is advantageous as it eliminates any wobbling of the carriages 40 and 41 and decreases any resistance to the carriage's movement along the guide rails 30 and 31.

Figure 8A:
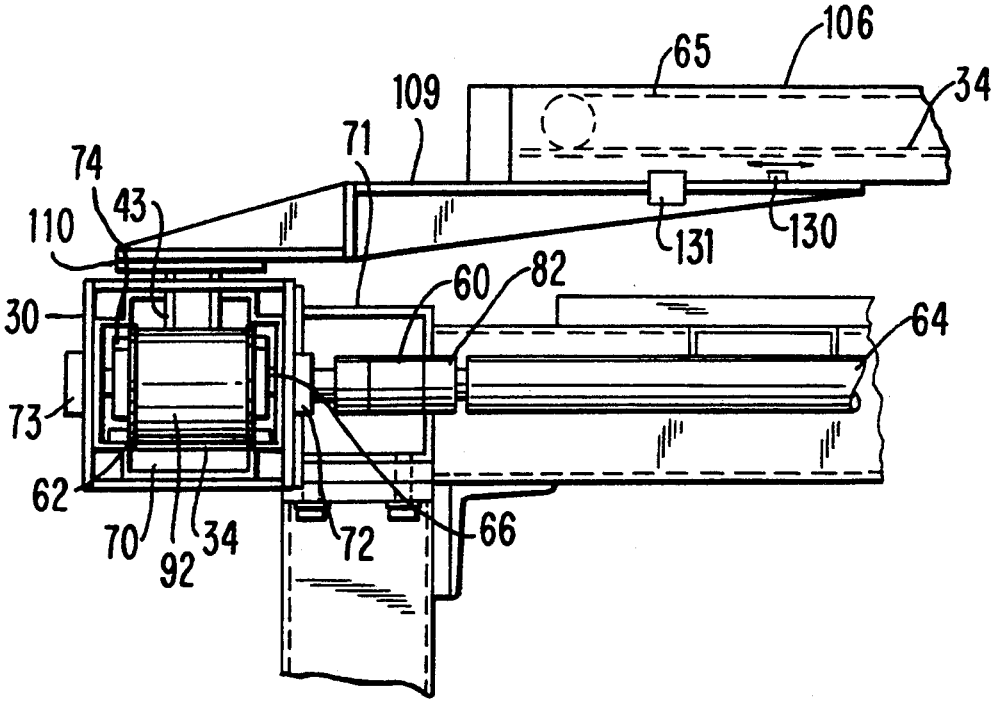

Each carriage has a wheel trolley 43 that is inset in the guide rail and rides on the floor 34 of the guide rails 30 and 31 shown in FIG. 8 and 8*a*.

Each wheel trolley 43 has a number of wheels 43*a* that ride the rectangular box section of guide rails 30 and 31. These wheels 43*a* engage all four sides of the rectangular box section and are adjustable to ride snugly against each side by an eccentric wheel 43*a* axle adjustment (not shown). There are at least two wheels 43*a* per side for each of the walls of the box section of guide rail 30 and 31 and one side of wheel trolley is shown in FIG. 7*a*. Inasmuch as each of the guide rails 30 and 31 has an open slit 32 in the top surface 32*a* of the guide rail, e.g. 30, to provide more stability, at least a pair of wheels 43*a* are located to engage the top surface on each side of the slit 32 for each of the carriages 40 and 41.

Each carriage 40 and 41 is capable of moving in both directions along the x-axis on the guide rails 30 and 31, respectively. In one embodiment (FIG. 2) both carriages move in the same direction at the same speed, since carriages 40 and 41 are both driven by one x-axis motor 60; but each carriage 40 and 41 may be driven by an independently mounted motor 60. The x-axis motor is preferably a DC reversible motor, indexed to give precise position for control and as a feed back signal to the means for controlling the carriages' 40 and 41 position on the x-axis. Such control is advantageous for enabling precise driving of the carriages 40 and 41 in the forward and reverse directions. The x-axis motor is located at the head of the right hand guide rail 31 and adjacent to the feed station 20. Placement of the motor 60 is at the designers option.

As illustrated in FIG. 2, 7 and 8, the x-axis drive motor 60 is driven through the transmission device 60*a*. The transmission device is of a type that provides for little backlash so as to control the precise positioning of the carriages 40 and 41 on the guide rails 30 and 31. From the transmission device as shown in FIG. 2 the motor power is transmitted through a coupler 60*b* for and interconnects with the x-axis drive shaft 64. On drive shaft 64 is mounted a sprocket wheel 62 around which is trained a rack like flexible rubber drive belt 65 of a surface entirely of teeth (not shown but complementary to the sprocket wheel 62). Two belts 65 are provided, one each for guide rail 30 and 31. One end of belt 65 is connected to a suitable connection 65*c* at one end of the wheel trolley 43 at 65*c* as shown in FIG. 7 with the other end connected to the other end of the wheel trolley 43, as shown in FIG. 7, and then trained around the same type of sprocket wheel 62 at the other end of the respective guide rails 30 and 31. The shaft 67 opposite to the end on which the motor 60 is located is an idle shaft which, however, serves the function of providing tensioning of the belt 65 via the idle sprocket wheel 62.

As shown in FIG. 7, the shaft 67 is mounted on the plate 69 and can be moved and fastened adjustably on the side of the guide rail, e.g. 30 by appropriate bolt mean for adjustment and securement as shown in FIG. 7*a* and thus allows imparting tension to the belt 65.

As further seen in FIG. 8, in the cross-section of the table 21, shaft 64 may be further provided with another coupling 60*b* on the left-hand side for guide rail 30 to absorb the shock loads when the carriages 40 and 41 are driven rapidly back and forth by the DC motor 60. A coupler 68 is also shown in greater detail in FIG. 8 and illustrate the principle of transmitting the driving force to carriage 40 in a minimized shock fashion.

A suitable housing 71 is provided for a bearing which is in a longitudinal, rectangular box section 71 and constitutes part of table 21. Box section 71 also houses the bearing 72. A complementary bearing 73 is shown on the left-hand side of the guide rail 30. A plenum 70 houses the guide belt 65. Plenum 70 is isolated from the guide rail 30 section in which the wheel trolley 43 rides, by floor 34 on which the wheel trolley 43 rides.

Turning now to the y-axis means for dispensing the thread, it has a y-axis motor 100 connected to a transmission 101. Transmission 101 is similar to transmission 60*a*. In a similar manner as shown and described for the driving of carriage 30, a similar belt 65 and sprocket wheel 62 arrangement is used for driving the shuttle 104 in a rectangular box section now called a gantry 106. Likewise, wheel trolley 43 is used in conjunction with shuttle 104 and is constructed in the same manner as described with reference to carriages 40 and 41 and their respective wheel trolleys 43. Still further, a slit 32 in the gantry 106 provides the same freedom of travel. In one embodiment of the invention, gantry 106 is rigidly connected to carriage 40 such as shown in FIG. 8*a*, by connecting bridge member 109.

The superstructure of each carriage 40 is in the previously identified, inverted U-form as shown in FIG. 2. On carriage plate 110 which is about the same for each carriage 40 and 41 is mounted the superstructure 42 which consists of two columns 111 and 112 each being a left and right hand column for each of the carriages 40 and 41. Thus, these columns 111 and 112 are also mirror images for the columns for their respective carriages 40 and 41. Above these columns 111 and 112 is mounted a platform 113 for locating spools 114 for supplying a thread 119. Although in FIG. 2 the illustration has shown the left hand carriage 40 to be different from the right hand carriage 41, as a practical matter the functions and the storage of the various materials used in making the sail material is not dependent on the right hand or left hand location of the devices, but rather on the flexibility needed for operating the machine in a given location and both sides, i.e. the one with the spools 114 and the one for the container for the adhesive 120 may be interchangeable.

Above the platform 113, at a sufficient distance above shuttle 104 is a thread feed arm 115. The thread feed arm 115 is mounted on a tower 116. The thread feed arm 115 has cross members 117 each of which has an eye 118 through which the thread 119 is being fed. A plurality of cross members 117 have been provided on the feed arm 115. Although in FIG. 2 only two spools 114 have been shown, a number of spools may be mounted on the surface platform 113 for dispensing individually or conjointly through a thread dispensing device 223 as further discussed herein individual threads or a combination of threads thereby allowing the production of a sail material in a variety of thread deniers, thread types and thread characteristics. An arm similar (not shown) to 115 may be mounted on the right hand carriage 41 for dispensing or connecting the shuttle 104 with additional pneumatic control lines, electrical control lines and the like (not shown). This device has not been shown but it duplicates the arm 115.

On the right hand carriage 41, a container 120 is illustrated for storing an adhesive which is connected to thread dispensing device 223 as will be further described herein.

As mentioned before the gantry 106 may be pivotally pinned to the right hand side carriage 41 and in a manner to allow the extension of the gantry 106, a slot 130 may be provided in gantry 106 as shown in FIG. 8*a* in which the gantry may extend or retract in a crank like manner from the left hand carriage 40. This slot has been illustrated as 130 in FIG. 8*a* and its complementary pin as 131. An overhead trolley (not shown) suspended from a ceiling and the like may move in unison with carriages 40 and 41 and lead the necessary electrical, pneumatic, etc. lines to the carriages 40 and 41.

One of the primary advantages when using a gantry 106 is that it is independently pivotable on each of the carriages 40 and 41. Accordingly, the machine output can be increased considerably as the forward and reverse movement of the x-axis motor 60 is considerably minimized. Thus, as seen in FIG. 1 for the first thread layout pattern 3, the left hand carriage 40 if independently driven from the right hand carriage 41 may remain stationary and only the right hand carriage 41 may be moving along x-axis of table 21. For thread layout pattern 4 as shown in FIG. 1 the left hand carriage 40 is moving at a reduced rate versus the right hand carriage 41. At the same time as shuttle 104 moves across table 21 the relative travel of the two carriages 40 and 41, respectively, is considerably reduced from that where the gantry 106 is permanently affixed to carriages 40 and 41.

In order to allow for sufficient pivoting of gantry 106 the two columns 111 and 112 for carriages 40 and 41 must be spaced apart on the mounting plate 110 such that the gantry 106 can freely swing between these two columns 111 and 112.

As a further illustration of the advantages shown by the present machine a guard strip 140 is provided to cover each of the slit 32 in the guide rail 30 and 31. Guard strips 140 are affixed at each end of the guide rail 30 and 31. At one end guard strips 140 may have guard strip tensioning device 141 while the other end may be permanently affixed at the opposite end of the guide rail 30 or 31. As shown in FIG. 2 the guard strip 140 is trained around a pulley 142. Pulley 142 rides on the carriage mounting plate 110 and the guard strip 140 is thereafter elevated onto another set of pullies 143 one pair of which are mounted in the upright columns 111 and the other in 112 for the carriages 40 and 41. Thereafter, a second set of pullies (not shown) at the bottom of the carriage mounting plate 110 serves the same function as pulley 142 for covering the slit 32 in each of the guide rails 30 and 31 in front or behind the travel path of carriages 40 and 41 as the case may be. Guard strip 140 thus prevents any dirt or other material from entering into the guide rail 30 and 31, i.e. in the rectangular box section and thus prevents any misalignment of the carriages 40 and 41 by dirt or debris when these move back and forth along the guide rails 30 and 31.

As shown in FIG. 2 a pair of electronic personal guard devices such as 145 and 146 are provided for the left hand and right hand side of the table to interrupt the machine operation should some inadvertent incursion occur in the path of the guard device such as in the path of photoelectric cell or the like device.

Figure 3:
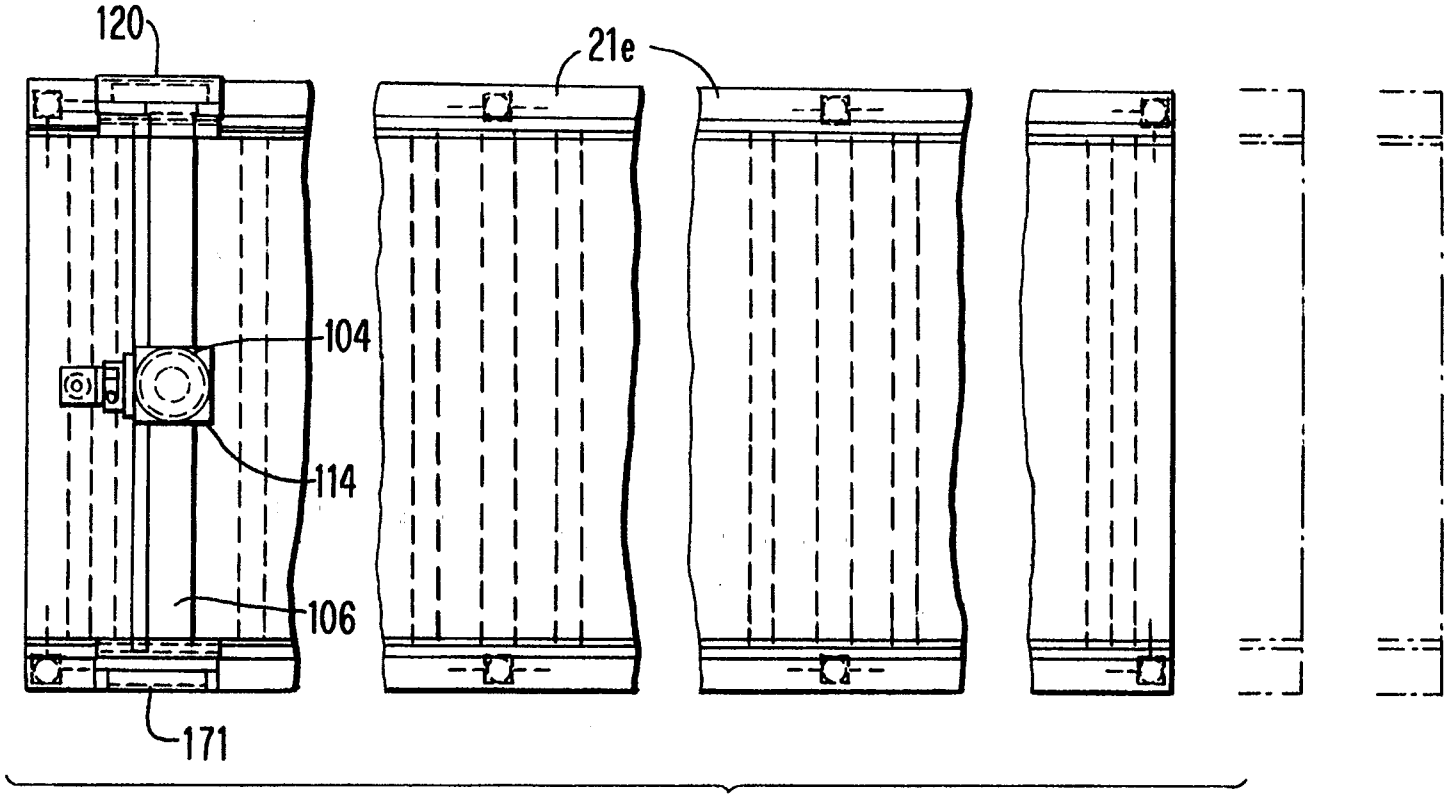
FIG. 3 illustrates in a plan view of additional embodiment of a gantry system with a thread feeding/dispensing head.
Figure 4:
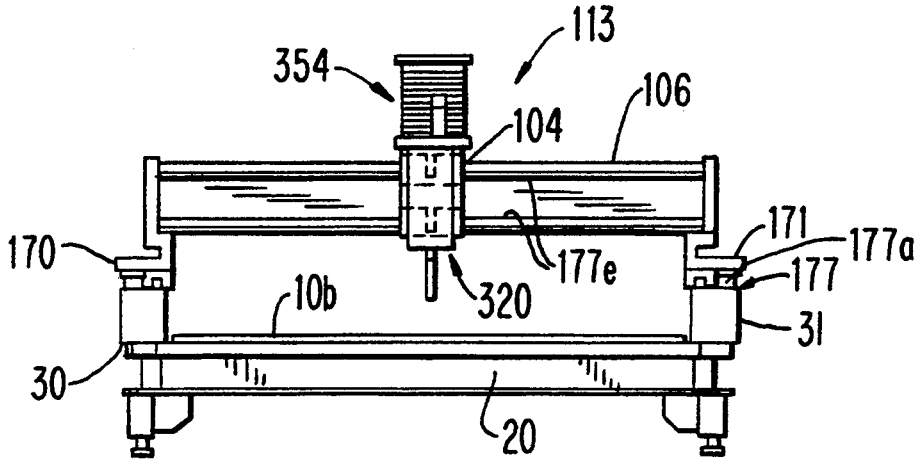
FIG. 4 illustrates in a front view the gantry system shown in FIG. 3 in plan view.
Figure 6:
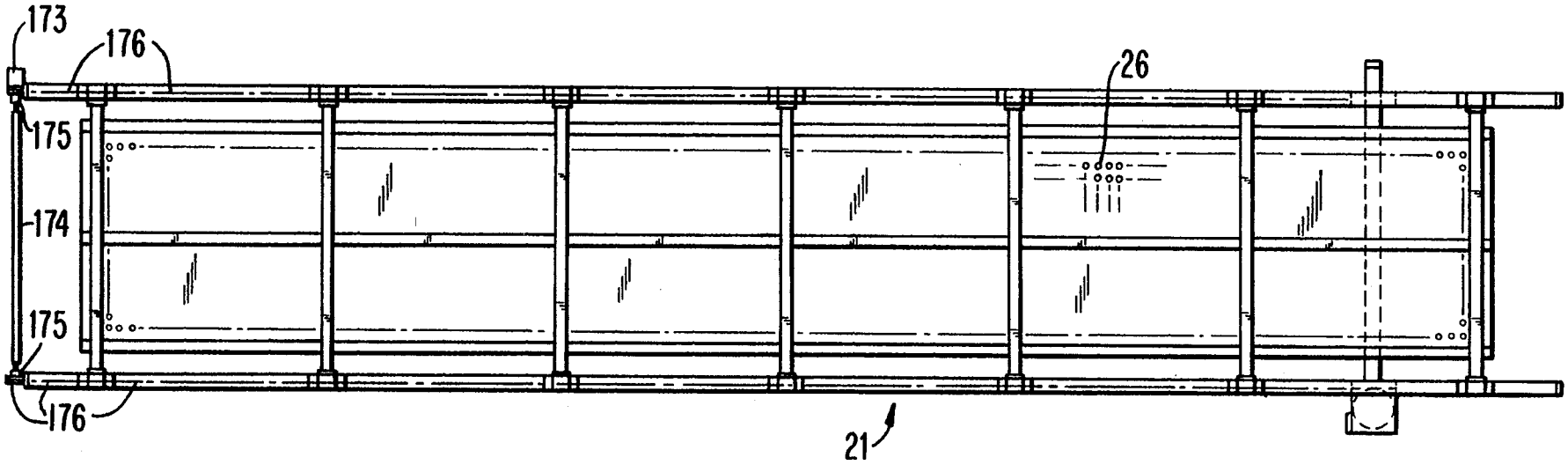
FIG. 6 illustrates in a plan bottom view a vacuum table assembly.

In FIG. 3 an illustration is shown for another embodiment. A gantry 106 rides on two carriages 170 and 171 the upper and lower carriage in FIG. 3, respectively (or the left hand and right hand carriage 170 and 171 in FIG. 4). Each carriage 170 and 171 is driven by a motor 173 as shown in FIG. 6 (showing a bottom view of the table 21) driving a shaft 174 at both ends of which are sprocket wheels 175 driving a chain 176. The interconnection for the chain is the same for a carriage 40 and 41 shown in FIG. 2 and previously described. Conversely, the gantry 106 may have a pair of carriages 171 which have each a high force linear motor 177*a* mounted on the same with a pinion wheel (not shown)and a pair of racks on the guide rails 30 and 31 as illustrated in FIG. 4. The high force linear motor 177*a* then drives the motor 177*a* in a ratio with the related high force linear motor 177*b* on the gantry 106 in the desired manner to make a sail material as shown in FIG. 1 as 3 or 4.

As seen in FIG. 4 the table 20 with a film 10*b* thereon has the gantry 106 traveling back and forth by the same type motor 177*b* with a pinion wheel (not shown) via its complementary racks 177*e*.

Figure 5:
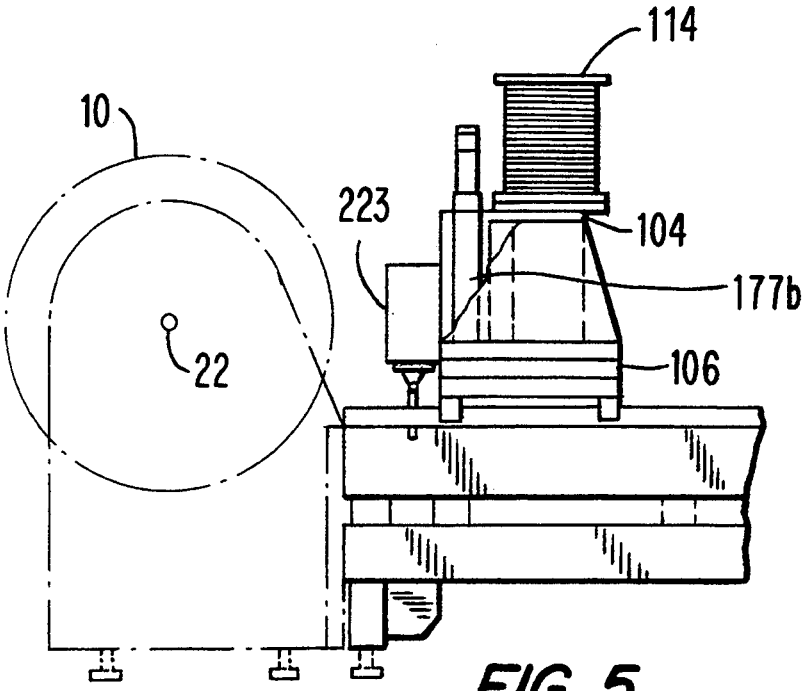
FIG. 5 illustrates in an end view the gantry system shown in FIG. 3.

In FIG. 5 for this embodiment is shown, however, an aramid thread spool 114 which is mounted directly on top of the gantry 106 and its shuttle 104. In FIG. 4 and 5 the electrical connections for the sake of clarity have not been shown in these figures.

Again, the thread dispensing means 223 will be further described herein in connection with FIG. 9 to 11. In FIG. 3 the expansion capability of the table 21 has been shown by the addition of 11 foot modular table sections 21*e*.

Figure 9A:
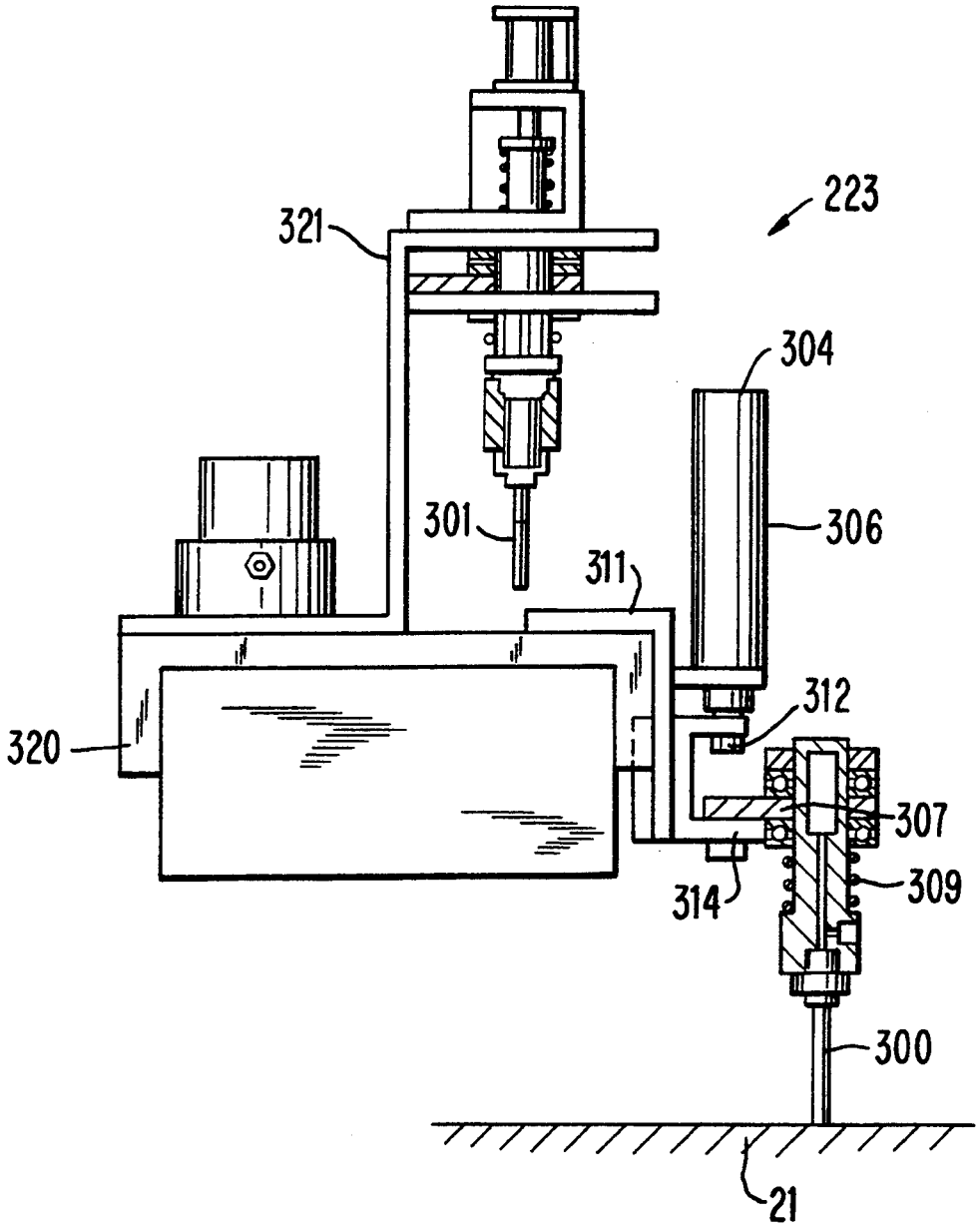

Housed on the shuttle 104 are various emodiments of thread dispensing means 223 (FIGS. 3, 4, 5, 9, 9*a*, 10, 10*a*) used in conjunction with various adhesives. As shown in FIG. 9*a* in side view of the thread dispensing means 223 (also shown in FIG. 10 in front view), the thread dispensing means 223 is comprised of a thread head 300, supplemental thread heads 301, a one stroke or two stroke spring loaded pneumatic cylinder 304 attached to a source of air or other gas under pressure 306, a mounting plate 307 and a stationary plate 311. The various thread heads, e.g. 300 and 301 may be used to dispense individual strands of thread including such as carbon, polyalkylene, e.g. Spectra, aramid, e.g. Kevlar, polyester, etc. The air cylinder 304 applies air pressure to the floating plate 314. The floating plate 314 is movable in the vertical direction, and is attached to the stationary plate 311. Movement of the floating plate 314 in the vertical direction is caused by application of air pressure and results in the retraction and extension of the thread heads 300, but the floating plate enjoys enough play which is provided within the last one half inch of air cylinder 304 travel such that thread head 300 can "float" over any irregularities on the surface 21*b*.

In one embodiment (FIG. 9, 9*a*), the air cylinder 304 is a two stroke air cylinder which is located vertically above the mounting plate 307. The stationary plate is attached to a thread head assembly 320 which with the upright member 321 constitutes part of the shuttle 104. Within the thread head assembly 320 is a spring 309 which provides flexibility and aids in "floating" the thread head 300.

Under normal pressure conditions, the thread head 300 is in contact with the table, and the floating plate 314 rests against the stationary plate 311.

In one embodiment (FIG. 10*b*), the thread head 400 is held in place by a C-clamp 430. In both embodiments, supplemental thread heads 301 and 302 are mounted on the thread dispensing means 223 for storage. As mounted, these supplemental thread heads, e.g. 301 are inactive; although, these are pre-loaded with their own source of thread to facilitate replacing of the operating thread heads 300, it is possible to operate the machine with more than one thread head 300. As many as three additional thread heads may be provided for this purpose.

Figure 10A:
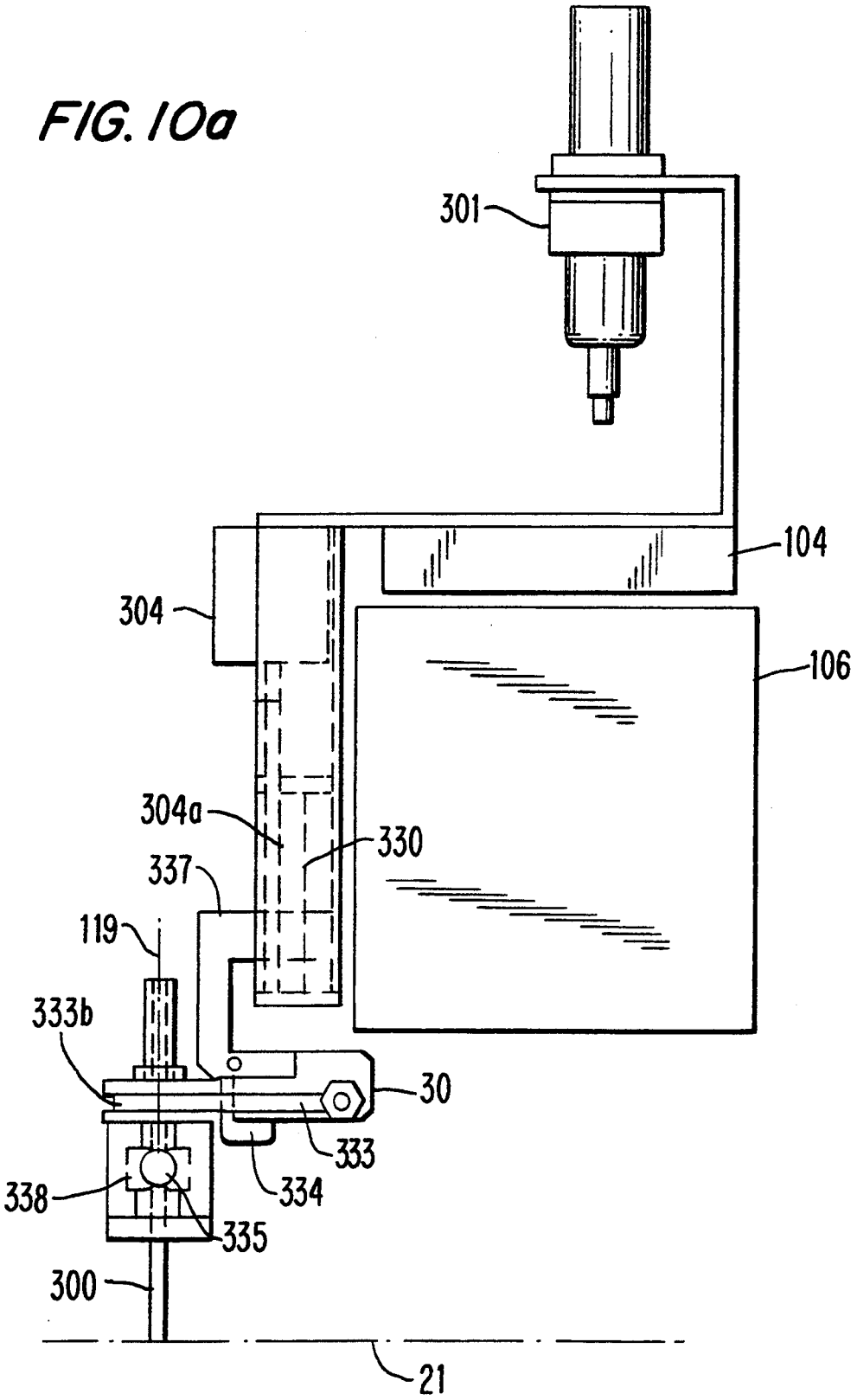
Figure 10B:
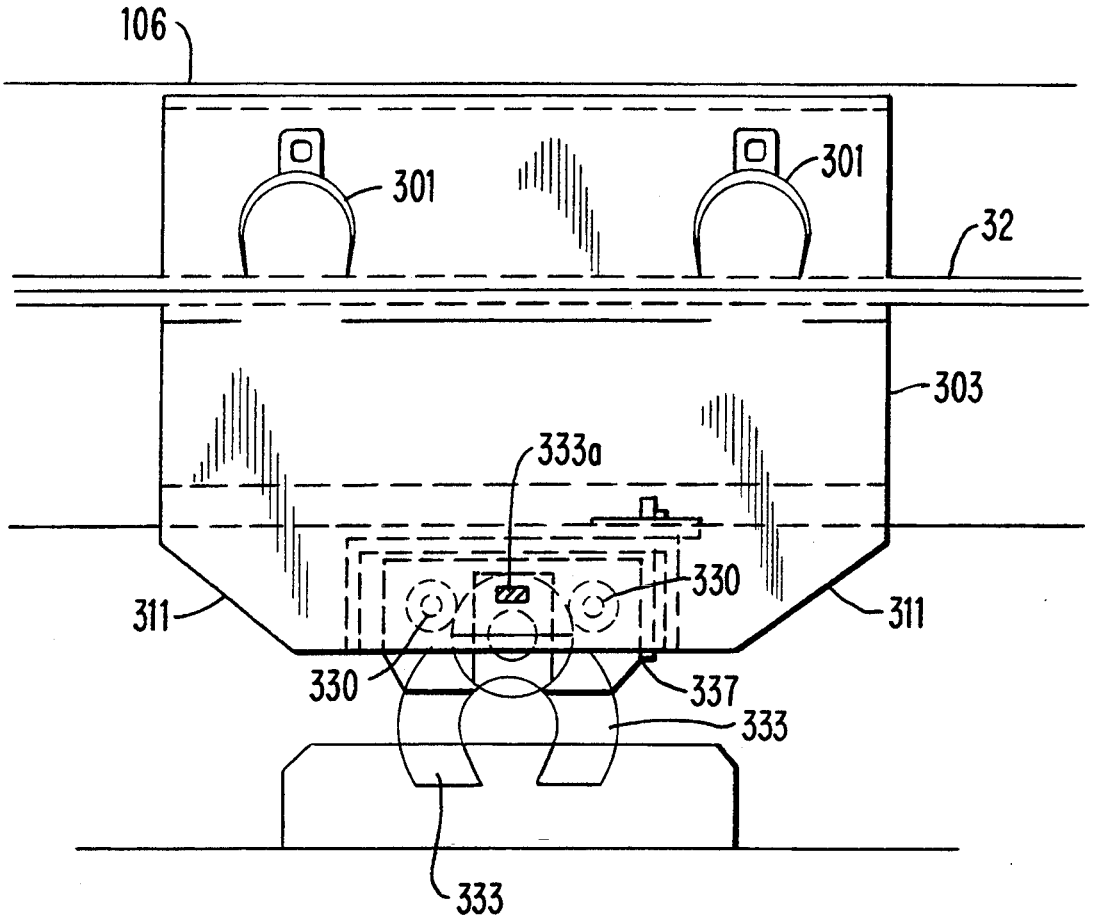

With reference to FIGS. 10, 10*a* and 10*b*, these figures illustrate another embodiment for mounting the thread dispensing means 223. As shown in FIG. 10*a* in cross section thereof the gantry 106 has mounted thereon the shuttle 104 which has the thread head 300 as well as the supplemental thread heads 301, shown both in FIGS. 10, 10*a* and 10*b*. The slit 32 has been shown in FIG. 10*b* in which the shuttle 104 rides in the same manner as the carriages 40 and 41. For the sake of clarity, the various details for the shuttle arrangement as well as the wheel trolley 43*a* has not been shown.

Turning now to FIG. 10, it illustrates the air cylinder 304 having a piston rod 304*a* yoked to the U-frame 337. In order to provide some stability for the U-frame 337 it has a pair of guide pistons 330 riding in guide sleeves 330*a*. The U-frame carries thereon at the bottom thereof, a scissor like acting C-clamp 333 which may be spring loaded by the spring 333*a* shown in FIG. 10*b* for easy opening and closing of same and mounting therein the thread head 300. The advantage of the scissor like C-clamp 333 is that it provides for easy replacement of the thread head 300 with a replacement thread head such as the stored supplemental thread head 301 or any other device such as a drawing head for drawing patterns on the film 10*a* or for a laser cutter for cutting broad seam curves in the sail material on table 21. The air cylinder 304, again serves the same function as previously illustrated for the device shown in FIG. 9 and 9*a* for lifting the thread head 300 off the table 21. Likewise, the air cylinder 304 has a floating function which allows for the thread head to move up and down. Some sideways movement is allowed because of the spring loaded, scissor like C-clamps 333. As shown in FIG. 10*a* the thread 119 enters the thread dispensing device 223 from the top. This will be further described, in greater detail, in conjunction with FIG. 11. The C-clamp 333 rests in the C-clamp groove identified as 333*b* in FIG. 10*a*. The pivot point for the C-clamp is shown as 334 in FIG. 10*a*. Adhesive from tank 120 enters through the adhesive entry port 335 shown in FIG. 10 and fills the chamber 338 again as shown in FIG. 10.

Turning now to FIG. 11 it illustrates the thread head 300 in cross section thereof showing the clamping groove 333*b* and the adhesive chamber 338. The adhesive entry port 335 provides for filling the chamber 338 under a pneumatic pressure exerted on tank 120 shown in FIG. 2. A stainless steel tube 340 is inserted at an appropriate height in the adhesive chamber 338, the height thereof may be adjusted by threaded adjustment nut 341 which has an O-ring for such purpose designated as 342. The bottom of the tube 340 appropriately adjusted above the bottom of chamber 338 with an appropriate spacing 344 provides the desired amount of adhesive entering into the passage 345 of the thread dispensing tool 346. The thread dispensing tool 346 is threaded into the thread dispensing cylinder 347 as shown in FIG. 11. A thread dispensing tool tip 348 may be threaded onto the thread dispensing tool 346 and should be made of a wear resistent material such as ceramic coated aluminum or a tool steel material such as D-1 or D-7 tool steel and the like wear resistent material. Upon its wear, this thread dispensing tool tip 348 may be unscrewed from the thread dispensing tool 346 and replaced with another replacement tip 348.

Figure 14A:
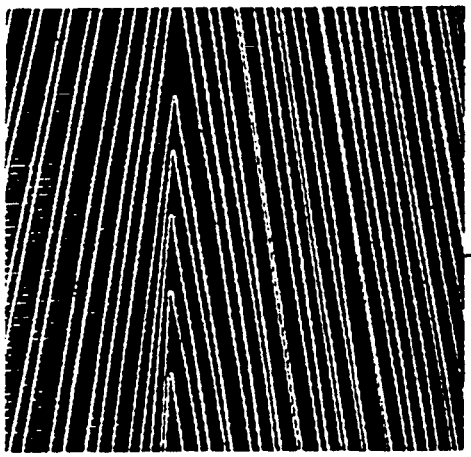
Figure 14B:
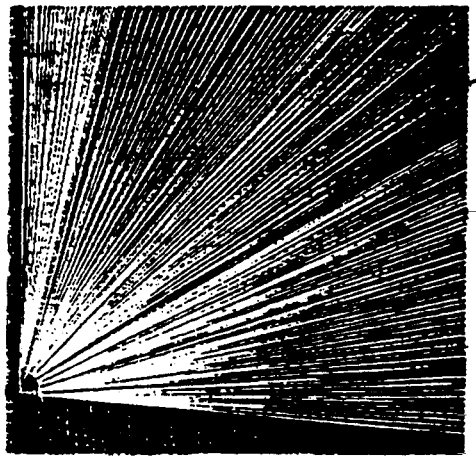

Turning now to FIG. 14 it illustrates the various possibilities for making the sail material by the machine as shown in FIGS. 1 and 2. In addition, in FIG. 2 on the Table 21 a hold down strip 5 has been shown which may consist of a number of pins arranged in the strip. These may be staples driven through a plastic strip with prongs 7 projecting upwardly, hooks, pins and the like. These pins 7 which have been schematically illustrated are made purposefully flexible so that the thread dispensing thread head 300 may easily deflect these pins, go around these and continue in the opposite direction yet at all the time the pins are strong enough to exert a taughtness on the thread 119. If intermediate points such as shown in FIG. 14*a* by the apex points of the threads are necessary, or if additional and supplemental layers of the thread must be laid down, such as for the high load bearing head panel shown as 3 in FIG. 1, then intermediate hold down strips 5*a* and 5*c* shown in FIG. 2 may likewise be placed adjacent to or spaced apart from the hold down strip 5. This allows the build-up of considerable number of thread which may then be secured such as for the heavily loaded clew section shown in FIG. 14*b* or for the heavily loaded head section such as shown in FIG. 1 as 3.

Figure 14C:
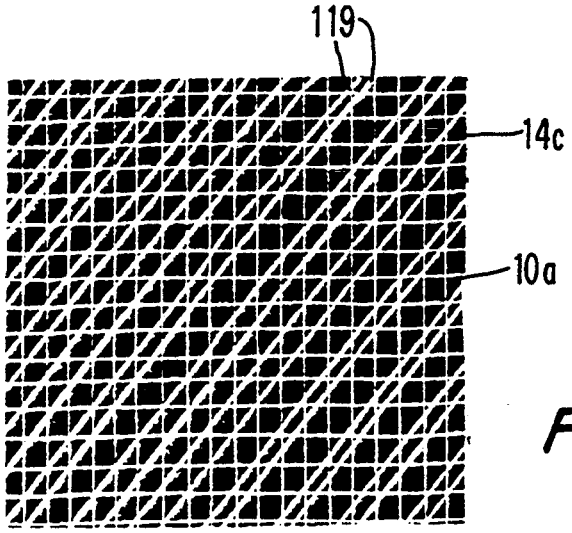

In addition, a hold down strip 5*b* may be placed in the y direction of the table and provided with pins 7 allowing a change in direction also as illustrated in FIG. 14*a*. In a typical high speed operation a film may be laid on the table such as 10*a* and it may be in the form of a scrim as shown in FIG. 14*c*. Through the thread head 300 may then be fed 2 strands of fibers such as aramid fibers as previously disclosed and laid down as the primary yarns on the scrim reinforced film 10*a*. In the operation of the machine as illustrated in FIG. 12 typically, the spools 114 may hold either Kevlar, i.e. an aramid fiber or a polyester fiber in one or the other. When one of the spools 114 is being used and if the inertia of the spool 114 is great and if this inertia exerts too much of a drag on the prongs 7 it may be necessary to provide the spool 114 with a driving assist for spinning the spool 114. These means are not shown but are readily available in the art such as torque responsive DC motor acting either in brakeing fashion or in a driving fashion. A similar device may be provided for one, two or more spools.

In operating the machine it has been found advantageous that the travel cycle be tailored in such a manner as not to subject both carriages 40 and 41 as well as the shuttle 104 to excessive inertial loads. Consequently, it has been found advantageous to safeguard the machine with a safety circuit the operating sequence of which is schematically illustrated for the safety boundary condition in FIG. 12 as well as supplement with the input, output devices as shown schematically by FIG. 13. These conditions are established by a number of available program blocks or programs that may be designed for the machine and for any of the sail shapes that are under production. These programmed controls are within the skill of the ordinary programmer. Conditions that have been illustrated in FIGS. 12 and 13 are merely for sake of illustration to show the versatility of the present machine. In a typical operation, the shuttle will have a fast transverse motion, a slow-down which may be achieved by brake means or other slow down means such as by the operation of the DC motor, then a turn around the pins 7 and an acceleration of the shuttle 104. Similarly, as the DC motor 60 moves the carriages back and forth it may be operated in such a mode that it has an acceleration and deceleration components to its travel as found suitable under the appropriate conditions.

Because of the versatility of the present machine such as when the gantry 106 is articulated on each of the carriages 40 and 41 there is less travel and the needed slow down and acceleration is only necessary for the shuttle 104.

Still further as shown by the embodiments in FIG. 3 to 6 various combinations of motors and devices may be provided to furnish the necessary means for operating carriages 40 and 41 in an acceptable manner. The illustration as shown in FIG. 2, however, has been found so far to be the preferrable embodiment. The advantages of that embodiment is that if the gantry 106 is made sufficiently high the air cylinder 304 may then be able to follow the contour of a mold 500 placed on the table 20. Although the mold has not been shown, the operating over a mold is easily accomplished because the pins 7 may be placed at the edge of the mold and the direction readily reversed. Similarly, if a number of hold down strips such 5*b* are used along the convex mold a number of turns may be introduced in a thread traveling in the composite x-, y- direction. Accordingly, then tension may be exerted on these threads and the appropriate thread lay out may be achieved. Although in practice it has been found preferable to operate on a flat table because of the significantly and economically faster production rates, production on molds on a concave surface by the machine as described in FIG. 2 is possible, however, at a sacrifice in speed, versatility and production rates.

For example, when making a molded sail, the film must be first placed on the mold and broadseamed to accommodate the shape of the mold. The borders of the sail are then defined by the sheet which has been broad seamed and the three dimensional surface.

A laminator (not shown) may be used in conjunction with the described machine and it may be wider or narrower than the table 21. The width of the film is dictated by the narrower of the two, thus also dictating the economy of the machine. Laminates include a laminate of the film with another film, a sandwich of at least another film, scrim and film, and a laminate with a woven cloth material. The types of laminating films which have been typically employed are polyvinylidine fluoride film and/or a polyester film and a number of others mentioned in the above patents to Conrad.

The table 20 of the present invention is also capable of accommodating a mold 500 (not shown) for a sail. Molds include convex molds. To make a one piece, three dimensional sail on such a mold, a single sheet of impervious pliant material is first placed on the mold. This first outer layer may be composed of film. The borders of the sail are defined by the sheet and the three dimensional surface. A plurality of continuous load bearing yarns are then applied in an uninterrupted fashion on the three dimensional sheet surface from one border to the other. A cam follower such as a wheel (not shown) may be interconnected with an air cylinder 304 and then lift the thread head 300 off the mold and thereby proportionally to the height of the mold.

A second pliant sheet is then applied over the laid out yarns and the first sheet, these are then laminated together on the mold. Adhesive may be applied to the sheets prior to such lamination. Typically vacuum bagging is used, but it is very slow.

The yarns are preferably applied under substantially uniform tension. They may be coated with an adhesive prior to their application to the first sheet. The load bearing yarns are arranged along certain major lines of stress that exist when the sail is placed in use. The above cam follower, movable over the mold surface may be used to apply the continuous strand of yarn to the first layer in both x- and y-axis direction. If the load bearing yarns are curved, pins 7 must be placed on the mold.

Various modifications and variations may readily apparent to those skilled in the art, however, the invention is defined by the scope of the claims to follow and all variations and equivalents within the scope of these claims.

What is claimed is:

1. A method for constructing a material with improved stress bearing characteristics including use of the material for distributing stress in a sail whereby said sail is capable of resisting aerodynamic and dynamic loading, said method comprising:

feeding a film from a film supply source onto a surface;

drawing a thread from a thread supply source;

applying an amount of an adhesive from an adhesive supply source to said thread upon a withdrawal of said thread from the thread supply source;

depositing said thread onto said film in a pre-determined thread layout pattern;

looping said thread around means for changing a direction for said threads and for providing tension in said thread, said means for changing direction for said thread being located on opposite sides of said film; and driving reciprocally x direction means and y direction means interconnected with each other; and in response to the depositing of said thread onto said film in a pre-determined thread layout pattern.

2. A method according to claim 1, including holding said film on said surface by vacuum.

3. A method according to claim 1, including controlling an amount of said adhesive applied to a thread by air pressure.

4. A method according to claim 1, including releasing a thread from the means for changing direction for the thread by a release means.

5. A method according to claim 1, including further the step of forming with another film a laminate of the film, subsequent to adherence of said thread to said film.

6. A method according to claim 5, wherein said film is laminated, after adherence of the thread to said film, to another film of polyvinylidene fluoride or a polyester.

7. A method according to claim 1, cutting said film after the completion of said predetermined thread pattern thereon in a predeterminedly established line along x-axis at least along one edge thereof.

8. A method according to claim 1, including dispensing thread from a plurality of thread supply sources.

9. A method according to claim 1, including assisting a thread supply source with means for dispensing a thread from a thread supply source.

10. A method according to claim 1, including retarding a thread supply source whereby increased tension on said thread achieved.

11. A method as defined in claim 1, including further the step of forming a laminate of the film, subsequent to the adherence of said thread to said film with a sandwich comprised of at least another film, scrim and a further film for said sandwich.

12. A method as defined in claim 1, including further the step of forming with a woven cloth material a laminate of the film, subsequent to the adherence of said thread to sail film.

13. An apparatus for constructing of a material with improved thread layout including for a sail material whereby said material is capable of better resisting aerodynamic and dynamic loading, said apparatus comprising:

a table;

a film dispensing means for dispensing said film on said table in an x- and y-axis direction;

a pair of guide rails one on each side of said table and along a length of said table along the x-axis thereof;

a pair of carriages, one on each side of said table slidably secured on said guide rails;

a means for reciprocally driving each individual carriage along a length of said guide rails, along the x-axis of said table;

a gantry means across the table in y direction thereof interconnected to each of said carriages;

at least one thread dispensing means slidably secured on said gantry for reciprocal movement on said gantry in y direction thereof;

means for positioning said carriages along the x-axis of said table and interconnected with means for positioning said thread dispensing means on said gantry; and a means for looping around a thread at each side of said table.

14. The apparatus as defined in claim 13 wherein the thread dispensing means includes a means for applying an adhesive to said thread prior to placement of said thread onto said film.

15. An apparatus according to claim 1, wherein the means for engaging the threads includes pins, prongs, and hooks.

16. An apparatus according to claim 13, wherein a table has a length of about 30 to 60 feet and a width from about 60 inches to about 180 inches and is capable of accommodating a mold for a sail.

17. In an apparatus for constructing materials with improved thread layouts for said materials to bear stress such as in a sail, said apparatus comprising:

a table;

a hold down means within said table for a film along an x- and y- axis of said table;

a pair of guide rails along the length of said table along x-axis and each side of said table;

a carriage means for each of said guide rails;

a gantry interconnected with each of said carriage means on each of the guide rails;

means for reciprocating said carriage means on said guide rails;

a thread dispensing means mounted on said gantry;

means for reciprocating said thread dispensing means on said gantry on a y-axis of said table;

said means for reciprocating said thread dispensing means and said means for reciprocating said carriage means interconnected with each other for dispensing a thread in a predetermined manner on said table along said x- and y-axis thereof.

18. The apparatus as defined in claim 17 further comprising along the table in the x-axis thereof, along each edge thereof, means for looping a thread around at least one set of thread engaging means.

19. The apparatus as defined in claim 12 further comprising means for looping a thread around and wherein the same includes a pin means, a prong means, or a hook means.

20. The apparatus as defined in claim 17, wherein at least one means for looping said thread around is along one edge of said table in at least one tier.

21. The apparatus as defined in claim 17 wherein a plurality of means for looping a thread around is along at least one edge of said table.

22. The apparatus as defined in claim 17, wherein said means for holding down a film includes vacuum.

23. The apparatus as defined in claim 17, wherein said guide rails along the edge of said table include means for independently moving said carriage means along each of said guide rails.

24. The apparatus as defined in claim 23, wherein said carriage means on each of said guide rails and said gantry include means for extendingly and contractingly articulating said gantry along x- and y-axis.

25. The apparatus as defined in claim 17, wherein the said gantry includes a multiple of thread dispensing means.

26. The apparatus as defined in claim 17, wherein the same comprises at least one engageable cutting means on said gantry for movement along said x- and y-axis of said table.

27. The apparatus as defined in claim 17, wherein the same comprises at least one engageable drawing means on said gantry for movement along said x- and y-axis of said table.

28. The apparatus as defined in claim 17, wherein the same comprises at least one engageable laser cutter means on said gantry for movement along said x- and y-axis of said table.

29. The apparatus as defined in claim 17, wherein said gantry includes clamp means for securing said film for deposit of said film on table along the length thereof.

30. The apparatus as defined in claim 17, wherein said table comprises at least one groove along each edge along x-axis thereof for retention of upward projecting prongs in said groove in a strip form in said groove.

* * * * *